US012391341B2

(12) United States Patent
Dupuis et al.

(10) Patent No.: US 12,391,341 B2
(45) Date of Patent: Aug. 19, 2025

(54) SEATING ASSEMBLY FOR A WATERCRAFT AND WATERCRAFT HAVING SAME

(71) Applicant: BOMBARDIER RECREATIONAL PRODUCTS INC., Valcourt (CA)

(72) Inventors: Felix Dupuis, Windsor (CA); Philippe Marcoux, Sherbrooke (CA); Alexandre Lecointre, Orford (CA); Ghyslain Beland, Granby (CA); Simon Laurin, Boucherville (CA); Vincent Froidevaux, Saint Priest (FR); Hugo Martin, Knowlton (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 502 days.

(21) Appl. No.: 17/885,919

(22) Filed: Aug. 11, 2022

(65) Prior Publication Data

US 2023/0192246 A1 Jun. 22, 2023

Related U.S. Application Data

(60) Provisional application No. 63/292,641, filed on Dec. 22, 2021.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | | |
|---|---|---|---|---|
| 11,420,715 | B1 | 8/2022 | Simard et al. | |
| 11,459,064 | B1 | 10/2022 | Simard et al. | |
| 11,634,195 | B1 * | 4/2023 | Dupuis | B60N 2/01566 114/364 |
| 11,738,833 | B1 | 8/2023 | Morin-Savard et al. | |
| 2021/0024177 | A1 * | 1/2021 | Perkins | B63B 29/06 |

* cited by examiner

*Primary Examiner* — S. Joseph Morano
*Assistant Examiner* — Jovon E Hayes
(74) *Attorney, Agent, or Firm* — BCF LLP

(57) ABSTRACT

A seating assembly for a watercraft is provided. The watercraft has a deck including deck attachment features provided on an upper surface of the deck. The seating assembly includes: a padded mat for seating a user, the padded mat being configured to abut the upper surface of the deck, the padded mat having a mat attachment feature for selectively connecting the padded mat to the deck by engaging the mat attachment feature with one of the deck attachment features; and a backrest for supporting a back of the user, the backrest having a backrest attachment feature for selectively connecting the backrest to the deck by engaging the backrest attachment feature to an other one of the deck attachment features. The padded mat and the backrest are usable together to allow the user to sit on the padded mat and be supported by the backrest.

24 Claims, 17 Drawing Sheets

SEATING ASSEMBLY FOR A WATERCRAFT AND WATERCRAFT HAVING SAME

CROSS-REFERENCE

The present application claims priority from U.S. Provisional Patent Application No. 63/292,641, filed Dec. 22, 2021, the entirety of which is incorporated by reference herein.

FIELD OF TECHNOLOGY

The present technology relates to watercraft having a seating assembly.

BACKGROUND

Some watercraft such as pontoon boats include multiple seats for accommodating occupants of the watercraft. In some cases, seats and other furniture may be repositionable within the watercraft to allow customization of a layout of the watercraft. However, the fixed size and shape of the different seats may still impose some restrictions on the occupants of the watercraft, particularly for example for an occupant desiring to lounge in a more relaxed position. In addition, as watercraft are subject to frequent movement, providing a manner in which to secure furniture on the watercraft may be a challenge for some types of furniture.

In view of the foregoing, there is a need for a seating assembly for a watercraft that addresses at least some of these drawbacks.

SUMMARY

It is an object of the present technology to ameliorate at least some of the inconveniences present in the prior art.

According to an aspect of the present technology, there is provided a seating assembly for a watercraft, the watercraft comprising a deck including a plurality of deck attachment features provided on an upper surface of the deck, the seating assembly comprising: at least one padded mat for seating a user, the at least one padded mat being configured to abut the upper surface of the deck, the at least one padded mat comprising a mat attachment feature for selectively connecting the at least one padded mat to the deck by engaging the mat attachment feature with one of the deck attachment features; a backrest for supporting a back of the user, the backrest comprising a backrest attachment feature for selectively connecting the backrest to the deck by engaging the backrest attachment feature to an other one of the deck attachment features, the at least one padded mat and the backrest being usable together to allow the user to sit on the at least one padded mat and be supported by the backrest.

In some embodiments, the mat attachment feature and the backrest attachment feature are different; the plurality of deck attachment features includes a first deck attachment feature and a second deck attachment feature; the one of the deck attachment features is the first deck attachment feature; and the other one of the deck attachment features is the second deck attachment feature.

In some embodiments, the at least one padded mat has an upper face and a lower face, the lower face being configured to abut the upper surface of the deck; the mat attachment feature includes a plurality of resilient fasteners extending downwards from the lower face; and the one of the deck attachment features comprises a plurality of first recesses for receiving the resilient fasteners.

In some embodiments, the padded mat is generally rectangular; and the resilient fasteners are disposed near respective corners of the padded mat.

In some embodiments, the backrest attachment feature comprises a pivotable attachment member that is operable by the user for rotation thereof about a pivot axis; and the other one of the deck attachment features comprises at least one opening for receiving part of the pivotable attachment member therein.

In some embodiments, the pivotable attachment member comprises a plurality of hooks; the at least one opening is a plurality of openings; the hooks of the pivotable attachment member are insertable into respective ones of the openings; and when the hooks are inserted into the openings, the hooks are pivotable about the pivot axis between an unlocked position whereby the hooks are freely removable from engagement with the openings and a locked position whereby the hooks are prevented from being removed from engagement with the openings.

In some embodiments, the backrest comprises a base connecting portion and a back support portion connected to the base connecting portion; and the base connecting portion comprises the backrest attachment feature.

In some embodiments, the back support portion extends vertically higher than the base connecting portion.

In some embodiments, the back support portion extends upwardly from a front end of the base connecting portion.

In some embodiments, the seating assembly further comprises an armrest for supporting one of the user's arms, the armrest being usable together with the at least one padded mat and the backrest to allow the user to rest an arm on the armrest while sitting on the padded mat and supported by the backrest.

In some embodiments, the at least one padded mat is a plurality of padded mats; and the armrest is configured to be mounted between two adjacent ones of the plurality of padded mats.

In some embodiments, the armrest has an upper face and a lower face; the armrest comprises a flange extending from the lower face of the armrest; and the flange is insertable between the two adjacent ones of the plurality of padded mats to secure the armrest in place.

In some embodiments, the armrest comprises an armrest body defining the upper face and the lower face thereof; the flange is selectively connectable to the armrest body in one of plurality of flange positions; and a position of the armrest body relative to the two adjacent ones of the plurality of padded mats is adjustable by selectively connecting the flange in a different one of the plurality of flange positions.

In some embodiments, the armrest body defines a plurality of flange recesses for defining the plurality of flange positions, the flange being selectively connectable to the armrest body by inserting part of the flange within any one of the flange recesses.

In some embodiments, the armrest body has a first lateral end and a second lateral end; and the flange recesses are spaced apart from one another laterally such that the flange recesses are disposed at different distances from the first and second lateral ends.

In some embodiments, the armrest body comprises a stowing interface feature; and the armrest body is configured to be stowed by engaging the stowing interface feature with a corresponding connecting base of the watercraft such as to retain the armrest body on the connecting base.

In some embodiments, the watercraft comprises a rail at least partly surrounding the deck; and the seating assembly further comprises at least one rail pad configured to be connected to the rail, the at least one rail pad and the at least one padded mat being usable together to allow the user to sit on the at least one padded mat and be supported by the at least one rail pad.

In some embodiments, the at least one padded mat has an upper face and a lower face; a thickness of the at least one padded mat is measured from the upper face to the lower face; and the upper face of the at least one padded mat is distanced from the upper surface of the deck by a distance equal to the thickness of the at least one padded mat.

In some embodiments, a seating system for a watercraft comprises: a deck comprising a plurality of deck attachment features on an upper surface of the deck; and the seating assembly, the mat attachment feature of each of the at least one padded mat being engageable with one of the deck attachment features for selectively connecting the at least one padded mat to the deck, and the backrest attachment feature of the backrest being engageable with an other one of the deck attachment features for selectively connecting the backrest to the deck.

In some embodiments, the deck comprises a plurality of floor tiles defining the upper surface of the deck, each of the floor tiles comprising at least one of the deck attachment features.

In some embodiments, the at least one padded mat is a plurality of padded mats that are connectable to the deck at a front portion of the deck.

According to another aspect of the present technology, there is provided a watercraft comprising: a deck comprising a plurality of deck attachment features on an upper surface of the deck; a hull supporting the deck; at least one padded mat for seating a user, the at least one padded mat abutting the upper surface of the deck, the at least one padded mat comprising a mat attachment feature engaging one of the deck attachment features for selective connection of the at least one padded mat to the deck; a backrest for supporting a back of the user, the backrest comprising a backrest attachment feature engaging an other one of the deck attachment features for selective connection of the backrest to the deck, the backrest being disposed next to at least one of the at least one padded mat such that the user can sit on the at least one of the at least one padded mat and be supported by the backrest.

In some embodiments, the backrest comprises a base connecting portion and a back support portion connected to the base connecting portion; the base connecting portion comprises the backrest attachment feature; and the back support portion extends upwardly and rearwardly from the base connecting portion.

In some embodiments, the watercraft further comprises a rail at least partly surrounding the deck; the seating assembly further comprises at least one rail pad connected to the rail; and the at least one rail pad and the at least one padded mat being usable together to allow the user to sit on the at least one padded mat and be supported by the at least one rail pad.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
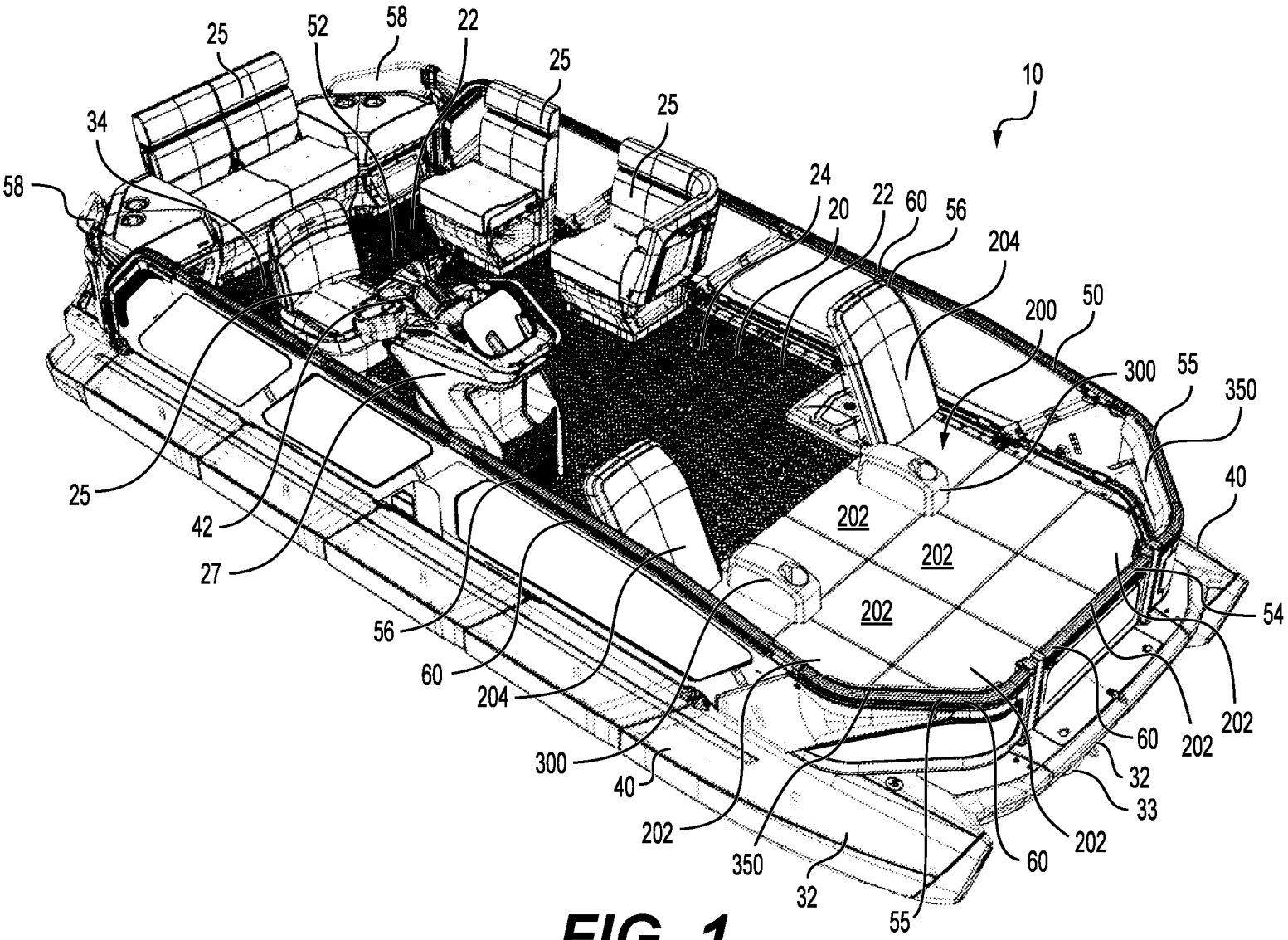
FIG. 1 is a perspective view, taken from a top, front, right side, of a pontoon boat in accordance with an embodiment of the present technology.

A watercraft 10 in accordance with one embodiment of the present technology is shown in FIG. 1. The following description relates to one example of a watercraft 10, notably a pontoon boat 10. Those of ordinary skill in the art will recognize that there are other known types of watercrafts incorporating different designs and that the present technology would encompass these other watercrafts.

The boat 10 has a deck 20 and a hull 32 supporting the deck 20. In this embodiment, the hull 32 includes three separate laterally-adjacent portions that are connected to one another to form the hull 32. Notably, the hull 32 has a central portion 33 and left and right lateral portions 40. These different hull portions could be considered separate hulls in some cases and thus the boat 10 may be referred to as a multihull watercraft in some cases. Nevertheless, it is contemplated that the hull 32 may constitute a single integral portion in other embodiments.

The deck 20 extends above the hull 32 and is supported thereby. The deck 20 has an upper surface 24 for supporting occupants, as well as accessories and accommodations of the boat 10 including various seats 25 and a command console 27. In this embodiment, the deck 20 includes a plurality of floor tiles 22 which are configured for attachment of accessories thereto. The tiles 22 form a portion of the upper surface 24 of the deck 20.

Figure 2:
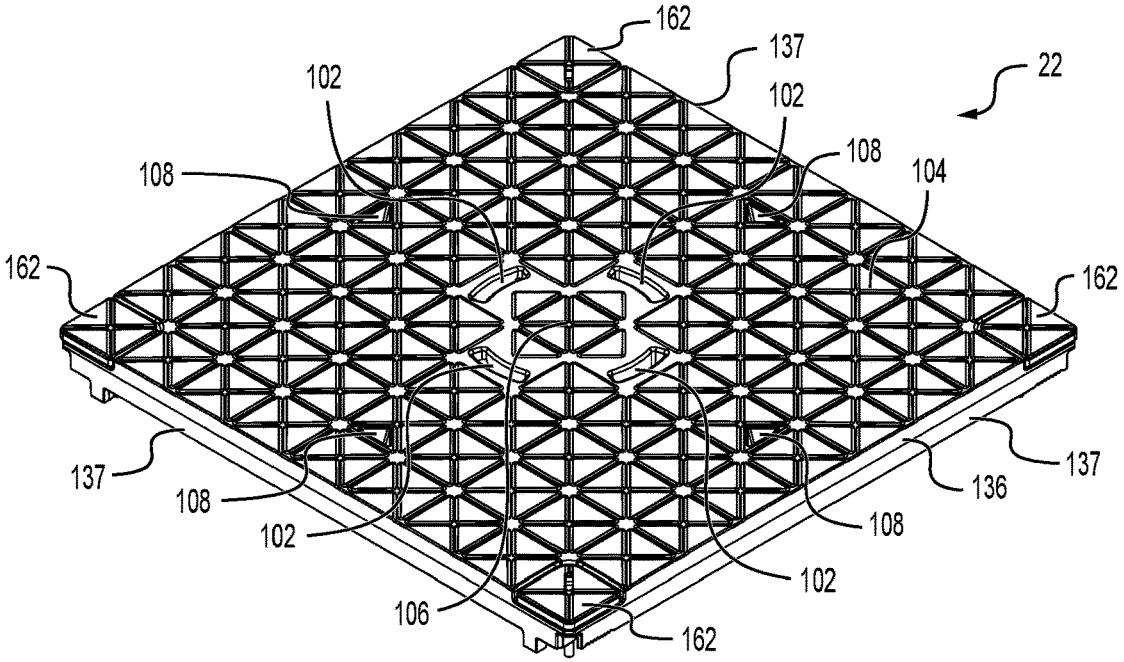
FIG. 2 is a perspective view, taken from a top, front, right side, of a floor tile of the boat of FIG. 1.
Figure 3:
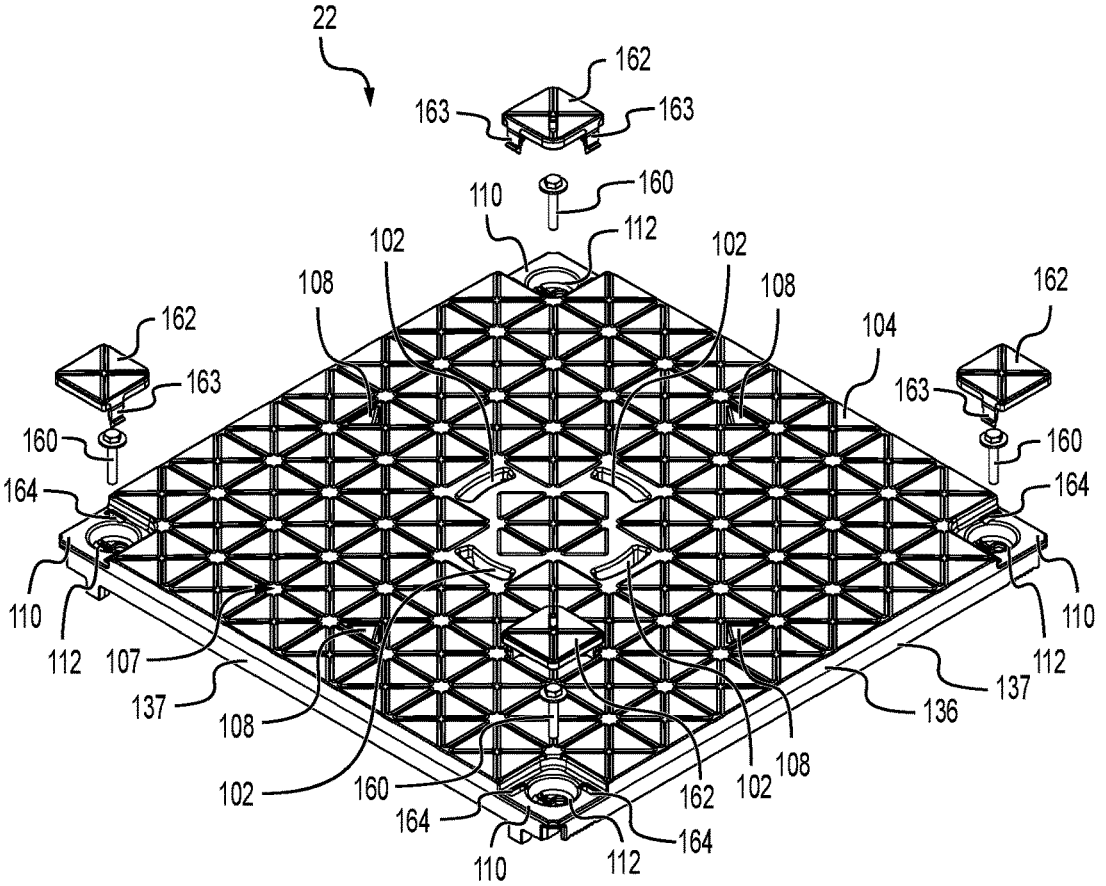
FIG. 3 is a perspective view, taken from a top, front, right side, of the floor tile of FIG. 2 shown in an exploded configuration.
Figure 4:
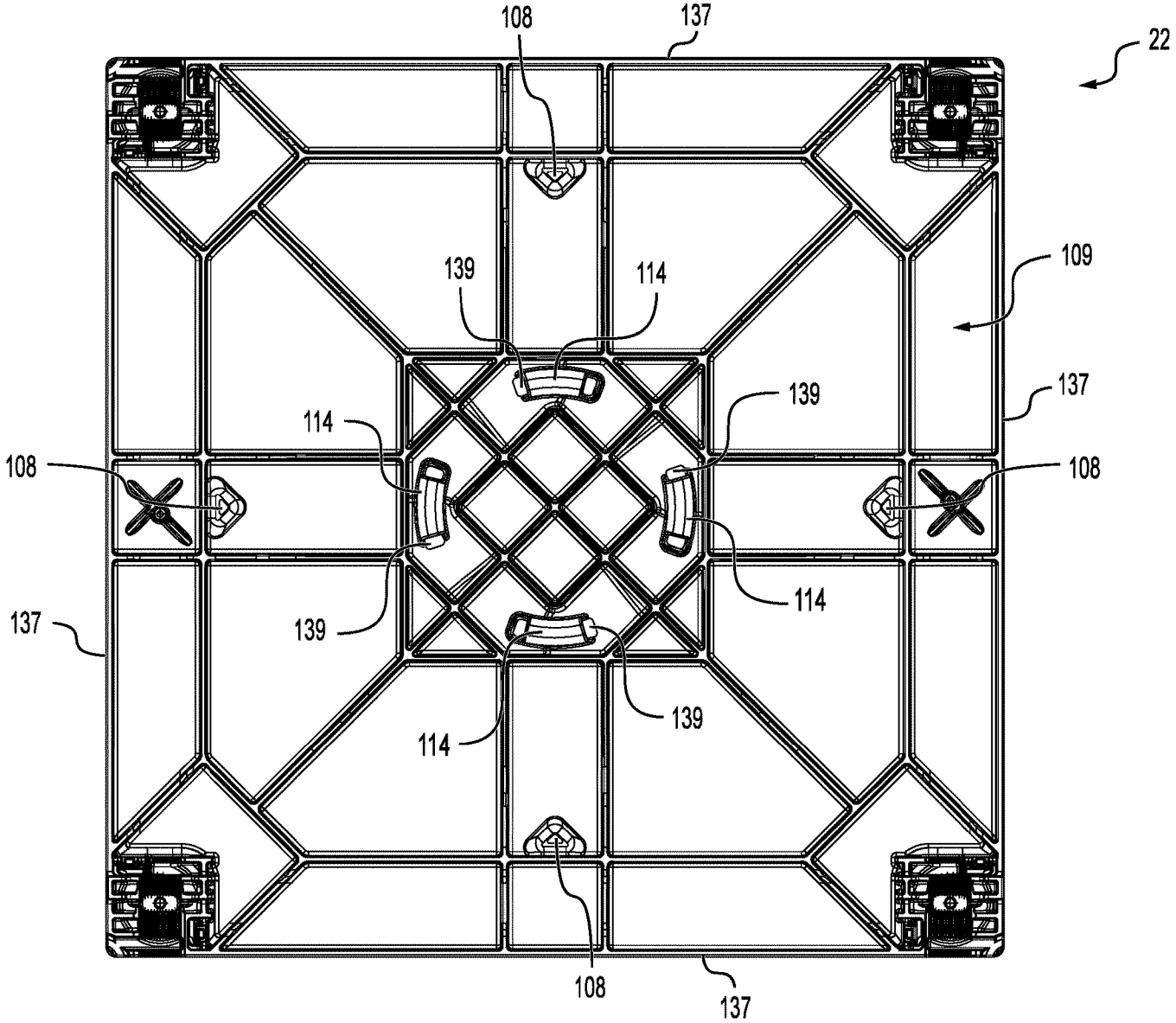
FIG. 4 is a bottom plan view of the floor tile of FIG. 2.
Figure 5:
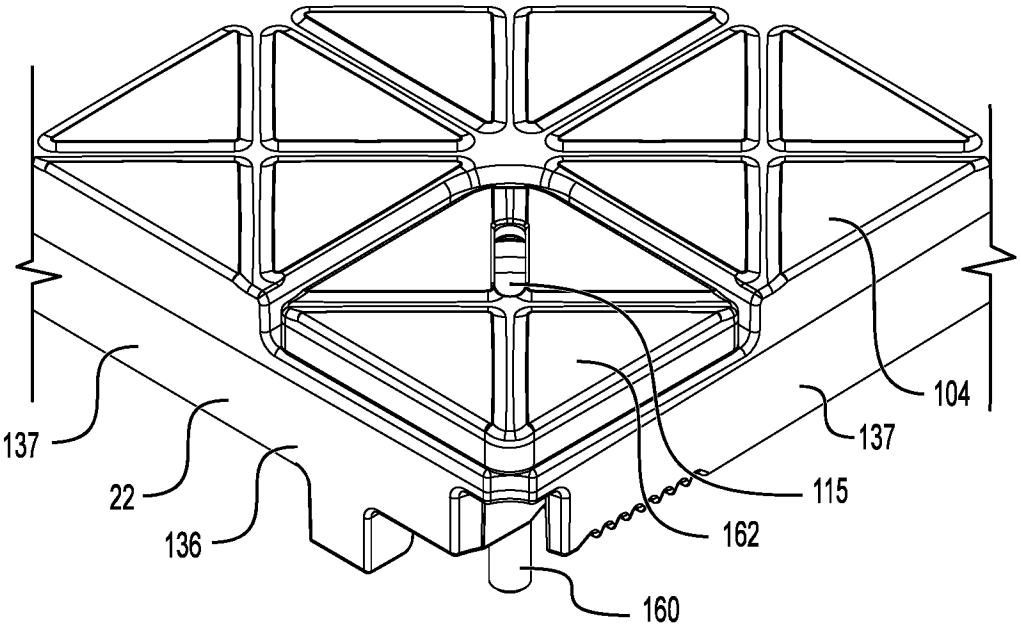
FIG. 5 is perspective view, taken from a top, front, right side, of part of the floor tile of FIG. 2.

An exemplary one of the tiles 22 is shown in FIGS. 2 to 4. As can be seen, in this embodiment, the tile 22 has a generally square shape defined by a perimetric wall 136 having four sides 137. The tile 22 has an upper surface 104, on an upper side 107, that extends perpendicular to the perimetric wall 136. A gripping texture is formed on the upper surface 104 of the floor tile 22. In this embodiment, the gripping texture consists of a repeating triangular pattern. As shown in FIG. 3, a mounting cavity 110 and a through aperture 112 are defined at each corner of the floor tile 22. On each corner, the through aperture 112 has an aperture axis perpendicular to the upper surface and is countersunk within a corresponding mounting cavity 110. Fasteners 160 are inserted via the through apertures 112 for fixedly attaching the floor tile 22 to a receiving surface of the deck 20 of the boat 10. With reference to FIG. 3, following the attachment by use of the fasteners 160, caps 162 are received in the mounting cavities 110 over the fasteners 160 to conceal the fasteners 160. The caps 162 have interlocking legs 163 that are received in respective recesses 164 defined by a surface defining a respective mounting cavity 110. Furthermore, as shown in FIG. 5, each cap 162 defines a recess 115 that extends from an upper surface of the cap 162 to a lower surface of the cap 162.

Returning to FIGS. 2 and 3, four openings 102 defined by the upper surface 104 of the floor tile 22. In this embodiment, the four openings 102 are arcuate slots 102. The arcuate slots 102 are defined about a common center of curvature 106 and are positioned at a common radius from the common center of curvature 106. The arcuate slots 102 are open both from the upper side 107 of the floor tile 22 and from an opposite lower side 109 (FIG. 4) of the floor tile 22. As shown in FIG. 4, each arcuate slot 102 is defined in part by a bottom wall 114 extending over a major part of an arc length of the arcuate slot 102, a lateral opening 139 being defined on a side of the bottom wall 114.

As will be described in more detail below, the recesses 115 and the arcuate slots 102 constitute respective deck attachment features for facilitating the attachment of accessories. Furthermore, in this embodiment, four positioning cavities 108 are defined by the upper surface 104 of the floor tile 22 and located radially outward from the common radius of curvature of the four arcuate slots 102. In this embodiment, the cavities 108 are recesses having a closed bottom. It is contemplated that the cavities 108 may consist of holes that fully pierce a material of the floor tile 22. It is contemplated that there could be more or less than four positioning cavities 108.

A more detailed description of the configuration of tiles similar to the tiles 22 and the manner in which they are used for attachment of accessories can be found in U.S. patent application Ser. No. 16/887,481, filed May 29, 2020, the entirety of which is incorporated by reference herein.

It is contemplated that the deck 20 could have a different construction. For instance, the deck 20 could have a more conventional construction such as including a metallic frame and an overlying flooring layer, such as wooden panels or plywood. It is further contemplated that the deck 20 could include multiple levels. It is also contemplated that the deck 20 could include differently sized tiles 22, for example larger tiles 22, and that each tile 22 include more than one set of recesses 115 and arcuate slots 102, or alternatively could include either recesses 115 or arcuate slots 102 but not both.

In this embodiment, the hull 32 and the deck 20 of the boat 10 have a modular construction. Notably, the hull 32 includes various modular units that are connected to one another to form the hull 32. In particular, the modular units of the hull 32 are longitudinally-adjacent to one another and therefore hulls of different sizes can be assembled depending on how many modular units are connected to one another. Similarly, the deck 20 is modular due to its construction by the tiles 22. Therefore, as will be understood, the boat 10 can have different lengths depending on the modular construction the deck 20 and the hull 32. The modularity of the hull 32 is described in greater detail in U.S. patent application Ser. No. 17/038,662, filed on Sep. 30, 2020, and in U.S. patent application Ser. No. 17/039,625, filed on Sep. 30, 2020, the entirety of each of which is incorporated by reference herein.

As shown in FIG. 1, the boat 10 is propelled by a jet propulsion system 52 (schematically shown in FIG. 1) powered by a motor (not shown). The jet propulsion system 52 has a steering nozzle (not shown) used for steering the boat 10. A handlebar 42 is operatively connected to the steering nozzle. A throttle lever (not shown) is operatively connected to the motor for controlling operation of the motor. The handlebar 42 and the throttle lever are located on the command console 27 provided on the deck 20. It is contemplated that other propulsion systems, such as a stern drive or a marine outboard engine, may be used to propel the boat 10. It is also contemplated that the handlebar 42 could be replaced by a steering wheel and that the steering nozzle could be replaced by an outdrive or one or more rudders. A powerpack of the boat 10, including the jet propulsion system 52 and the motor, is enclosed in part by the hull 32. A central hull cover overlies the powerpack to partly enclose the powerpack between the hull 32 and the hull cover. An upper surface of the central hull cover 34 is contiguous with the upper surface 24 of the deck 20 (i.e., flush therewith).

With continued reference to FIG. 1, the boat 10 has a barrier structure 50 surrounding at least part of the deck 20 and extending upwardly therefrom. In particular, the barrier structure 50 is located along a periphery of the boat 10 (as defined by the deck 20) to prevent occupants or objects on the deck 20 from accidentally falling off the boat 10. As shown in FIG. 1, in this embodiment, the barrier structure 50 generally surrounds the entirety of the deck 20. Notably, the barrier structure 50 includes a front end barrier portion 54, left and right lateral barrier portions 56, left and right rear corner barrier portions 58, and a rear end barrier portion (not shown). It is contemplated that, in other embodiments, the barrier structure 50 could only partially surround the deck 20. For example, one or more of the barrier portions 54, 56, 58 thereof could be omitted. The front end barrier portion 54, the left and right lateral barrier portions 56, the left and right rear corner barrier portions 58, and the rear end barrier portion are shaped differently and in some cases constructed differently. Nevertheless, in this embodiment, each of the barrier portions 54, 56, 58 includes a pliable sheet wall. Moreover, the front end barrier portion 54 and the left and right lateral barrier portions 56 each have a rail 60 defining an upper end of a respective one of the barrier portions 54, 56. The rail 60 is configured for the occupants of the boat 10 to hold onto the barrier structure 50.

As shown in FIG. 1, the boat 10 has a seating assembly 200 that is configured to accommodate occupants of the boat 10 wishing to lounge on the deck 20. As will be described in greater detail below, unlike the seats 25, the seating assembly 200 allows a user to sit down comfortably on the deck in a more relaxed position while his/her upper body is supported.

The seating assembly 200 includes a plurality of padded mats 202 for seating the user and backrests 204 for supporting the back of the user. As can be seen, in this embodiment, the seating assembly 200 has twelve padded mats 202 and two backrests 204 and is disposed generally along a front end portion of the boat 10. However, it is contemplated that any suitable number of padded mats 202 and backrests 204 may be provided in other embodiments, and the padded mats 202 and backrest 204 may be arranged differently in other embodiments. The padded mats 202 and backrests 204 are usable together to allow the user to sit on one of the padded mats 202 while his/her back is supported by one of the brackets 204.

Figure 8:
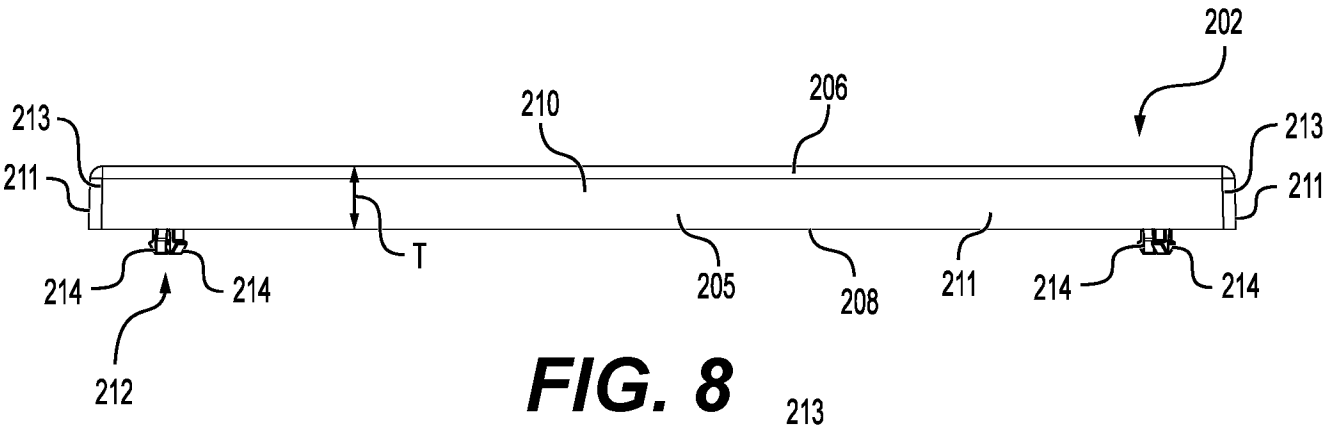
FIG. 8 is a side elevation view of a padded mat of the seating assembly of FIG. 6.
Figure 9:
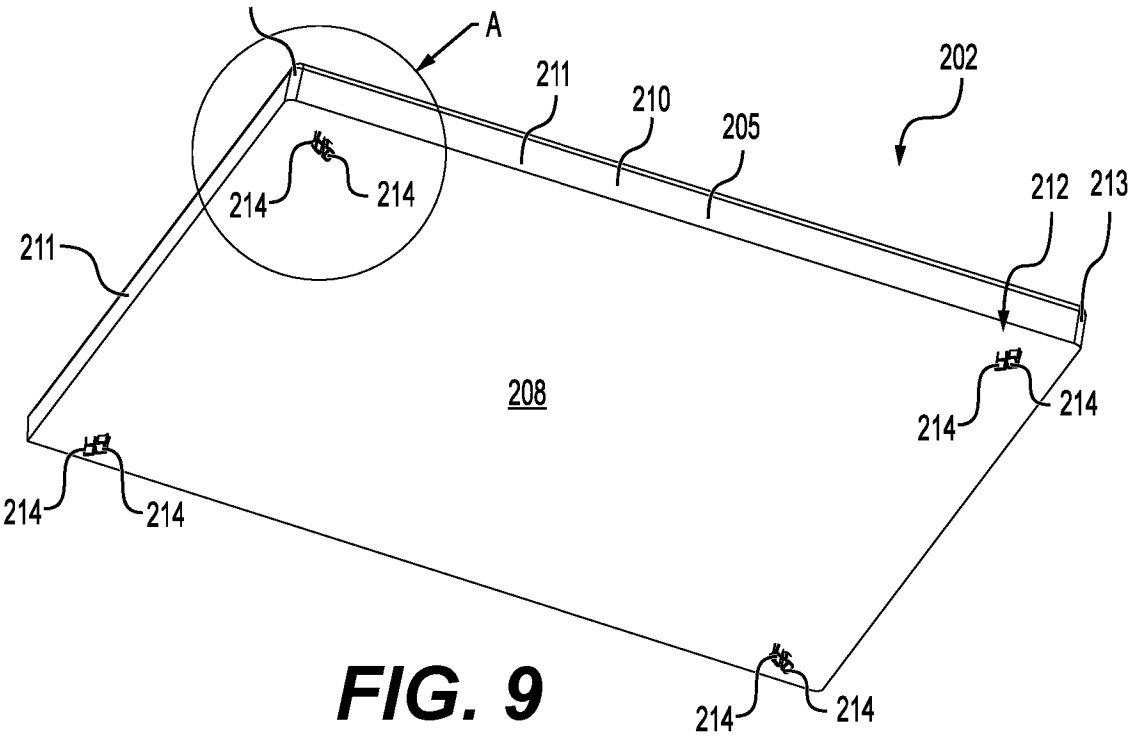
FIG. 9 is a perspective view, taken from a bottom, front, right side, of the padded mat of FIG. 8.

As shown in FIGS. 8 and 9, each padded mat 202 has a body 205 having an upper face 206 and a lower face 208 opposite the upper face 206. A thickness T of the padded mat 202 is measured between the upper and lower faces 206, 208. In use, the lower face 208 of the padded mat 202 abuts the upper surface 24 of the deck 20. In other words, the upper face 206 of the padded mat 202 is relatively close to the upper surface 24 of the deck 20. For instance, in use, the upper face 206 of the padded mat 202 is distanced from the upper surface 24 by a distance equal to the thickness T of the padded mat 202. In this embodiment, the thickness T of the padded mat 202 is between 0.5 cm and 10 cm. In one embodiment, the thickness T of the padded mat 202 is approximately 1 cm.

Figure 6:
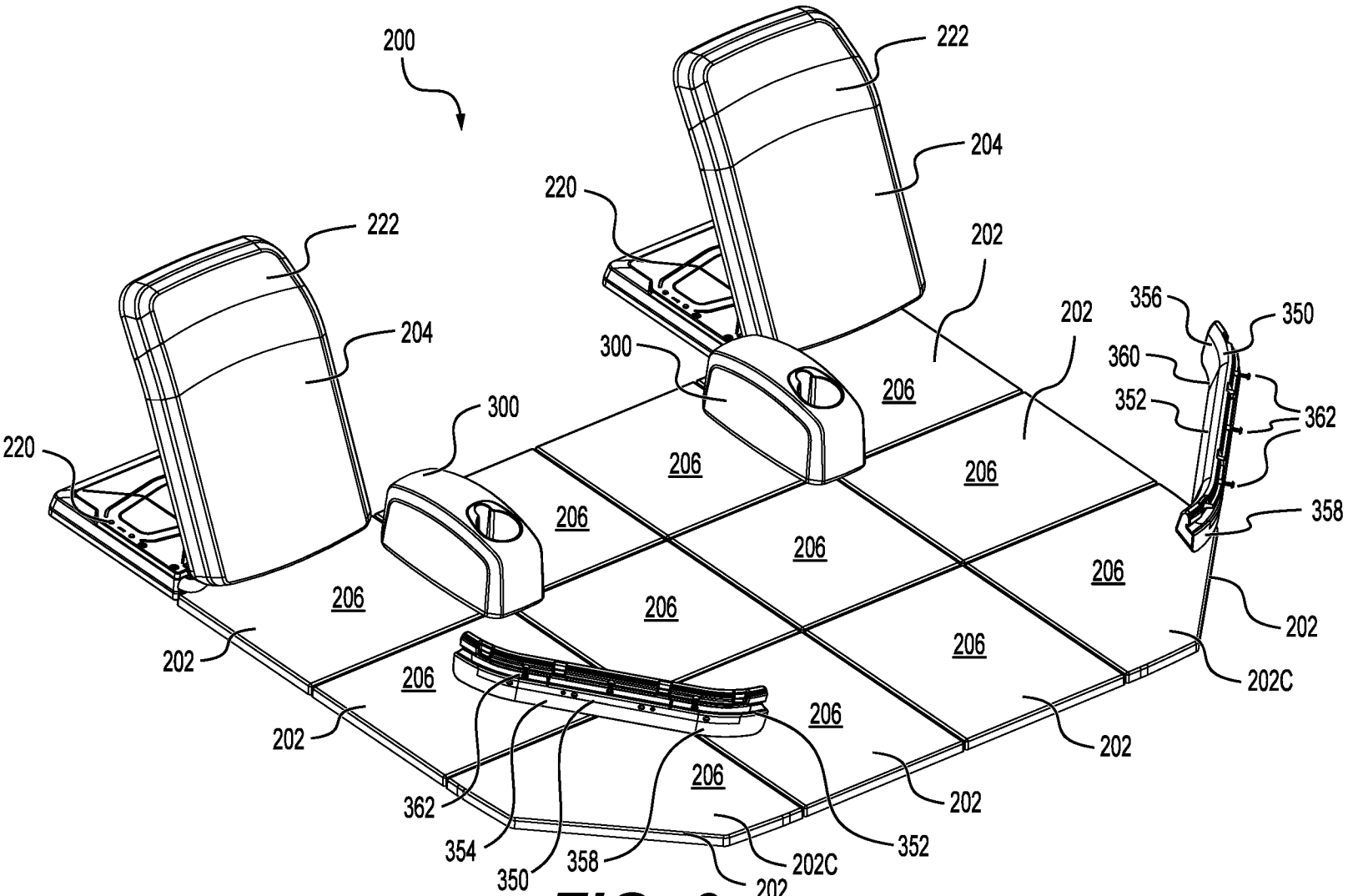
FIG. 6 is a perspective view, taken from a top, front, right side, of a seating assembly of the boat of FIG. 1.
Figure 7:
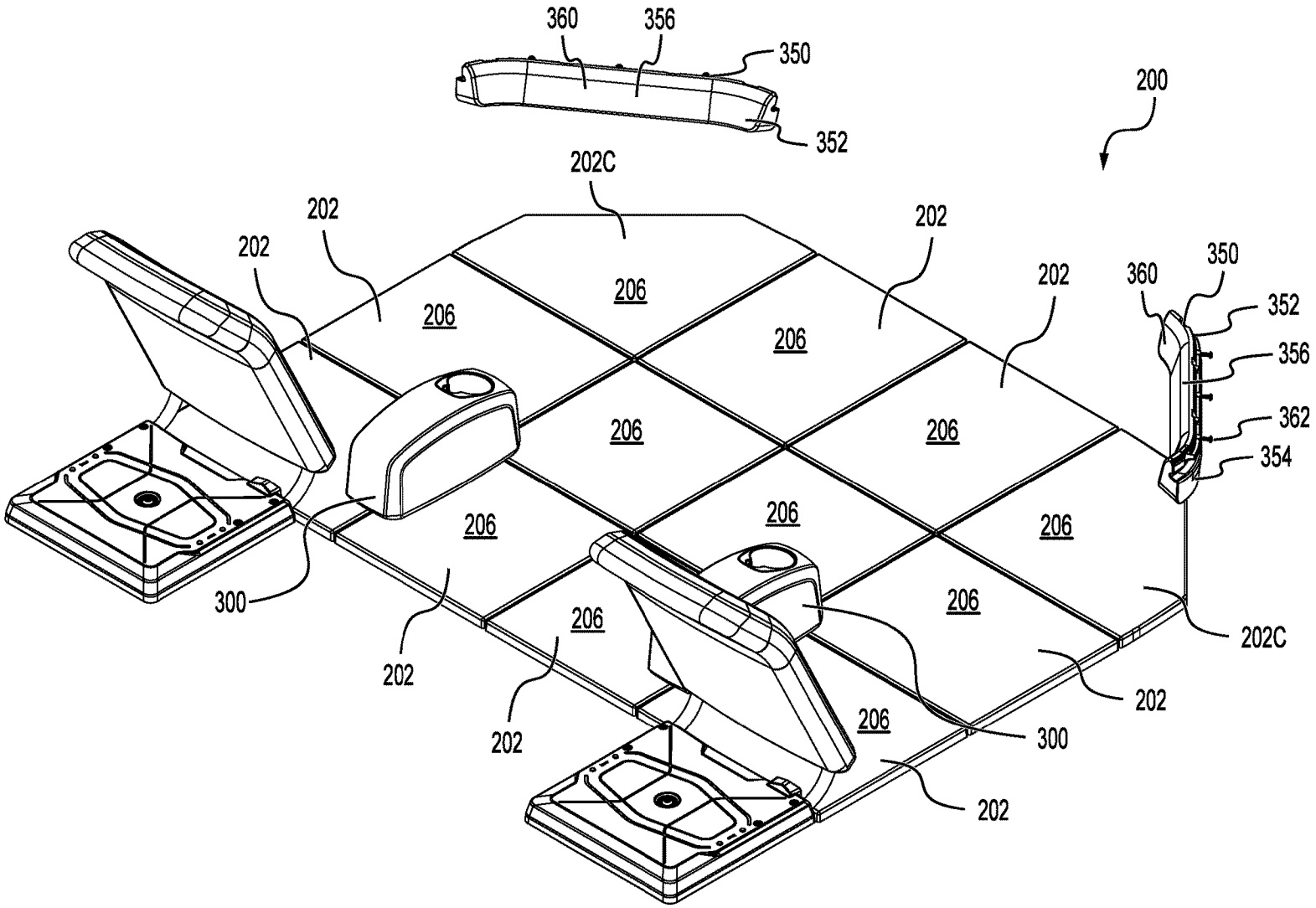
FIG. 7 is a perspective view, taken from a top, rear, right side, of the seating assembly of FIG. 6.

The padded mat 202 also has a perimetric wall 210 defining a shape of the padded mat 202. In particular, the perimetric wall 210 has a plurality of sides 211 which together define the shape of the padded mat 202. In this embodiment, a majority of the padded mats 202 have a rectangular shape, and particularly a square shape. As can be seen in FIGS. 6 and 7, two of the padded mats 202 are corner padded mats 202C and have a non-square shape, namely an irregular pentagonal shape. Notably, the two corner padded mats 202C are configured to be placed adjacent front end sections 55 (FIG. 1) of the left and right lateral barrier portion 56 of the barrier structure 50 which are angled towards a centerline of the boat 10. It is contemplated that, if the front end sections 55 were to be disposed square relative to the front end barrier portion 54, the corner padded mats 202C could also have a rectangular shape such as the other padded mats 202.

As shown in FIG. 9, the padded mat 202 has a mat attachment feature 212 for selectively connecting the padded mat 202 to the deck 20. More specifically, the mat attachment feature 212 allows the padded mat 202 to be secured to a corresponding one of the floor tiles 22 forming the upper surface 24 of the deck 20. In this embodiment, the mat attachment feature 212 includes a plurality of resilient fasteners 214 that extend downwards from the lower face 208 of the padded mat 202. In particular, for the square-shaped padded mats 202, two resilient fasteners 214 are disposed near each corner 213 (i.e., a junction between two of the sides 211 of the perimetric wall 210) of the padded mat 202 such that four pairs of resilient fasteners 214 are provided at corresponding corners 213. For the corner padded mats 202C, the resilient fasteners 214 are provided at each of the three square corners of the corner padded mat 202C and other resilient fasteners 214 are provided near a diagonal edge of the corner padded mat 202C.

Figure 10:
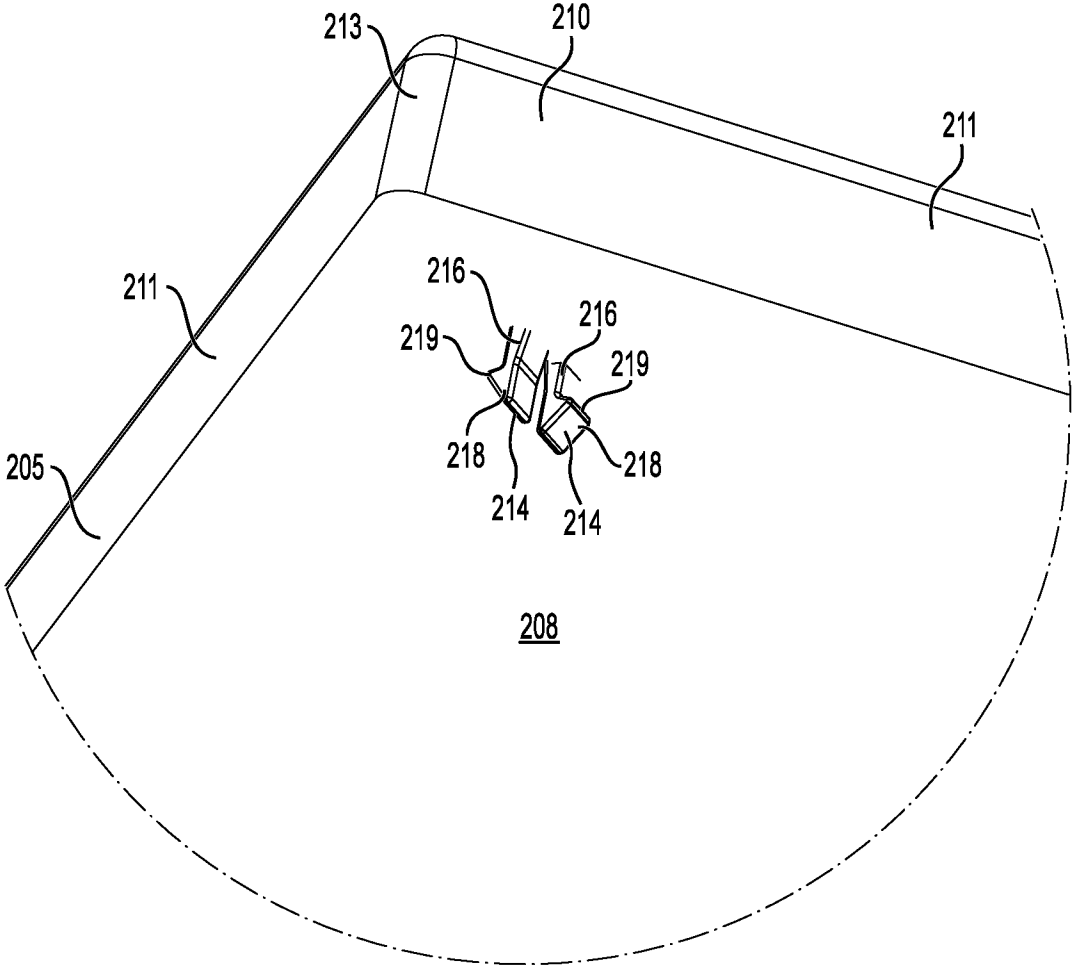
FIG. 10 is a detailed view of section A shown in FIG. 9.

With reference to FIG. 10 which shows one pair of the resilient fasteners 214 near a given corner 213 of the padded mat 202, each resilient fastener 214 has a stem 216 that extends downwards from the lower face 208 and an interlocking portion 218 at a lower end of the stem 216. The interlocking portion 218 is wider than the stem 216 to allow the interlocking portion 218 to be interlocked with a corresponding one of the floor tiles 22. In particular, in this embodiment, the interlocking portion 218 has a generally triangular cross-sectional profile and includes an outward-facing vertex 219 that extends away from the stem 216 such that it is offsert therefrom. As can be seen, the two resilient fasteners 214 are positioned side-by-side with a small spacing therebetween, and their respective outward-facing vertices 219 face in opposite directions from one another.

Figure 21:
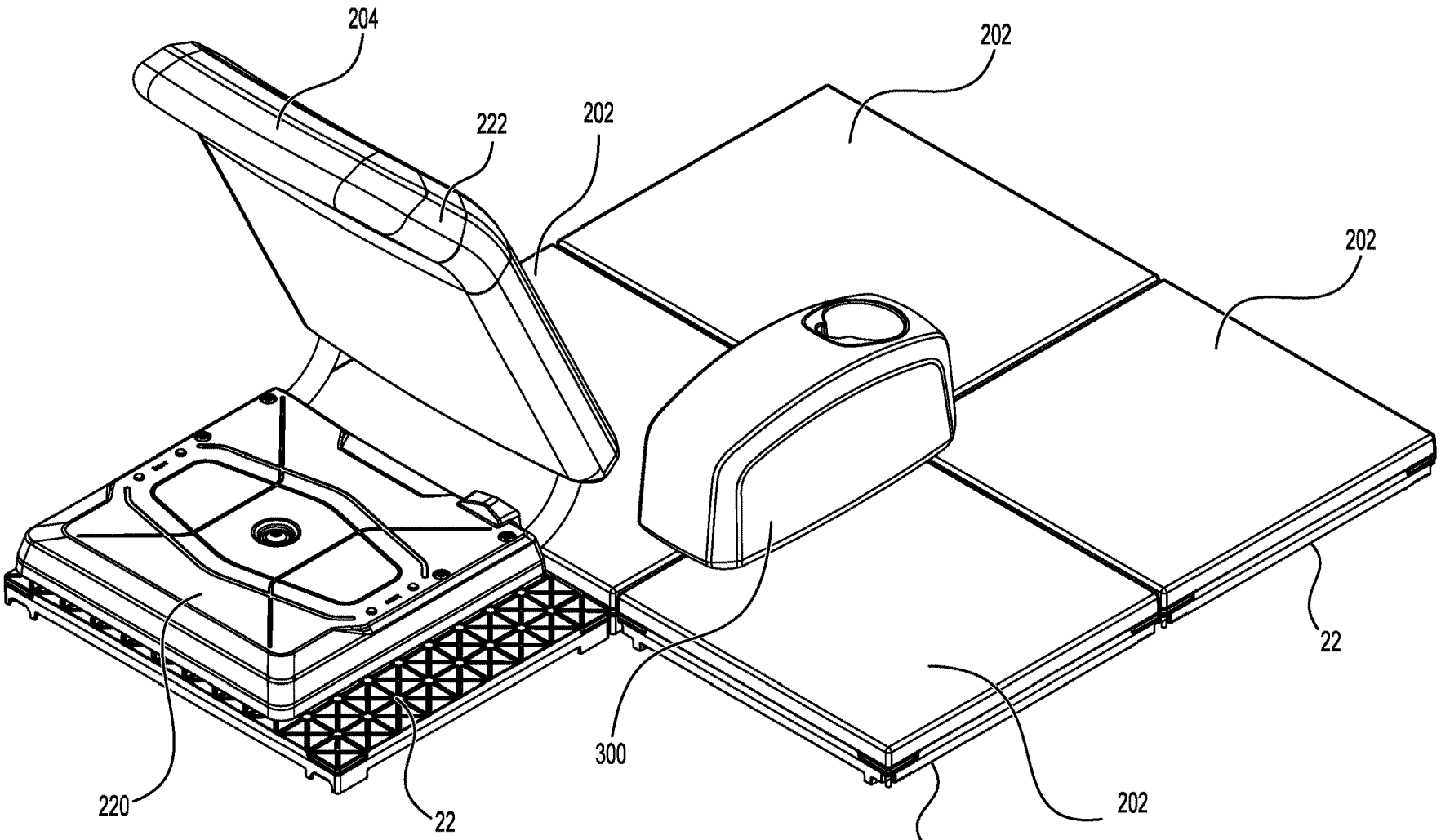
FIG. 21 is a perspective view, taken from a top, rear, right side, of part of the seating assembly of FIG. 6 and the floor tiles of FIG. 2.
Figure 22:
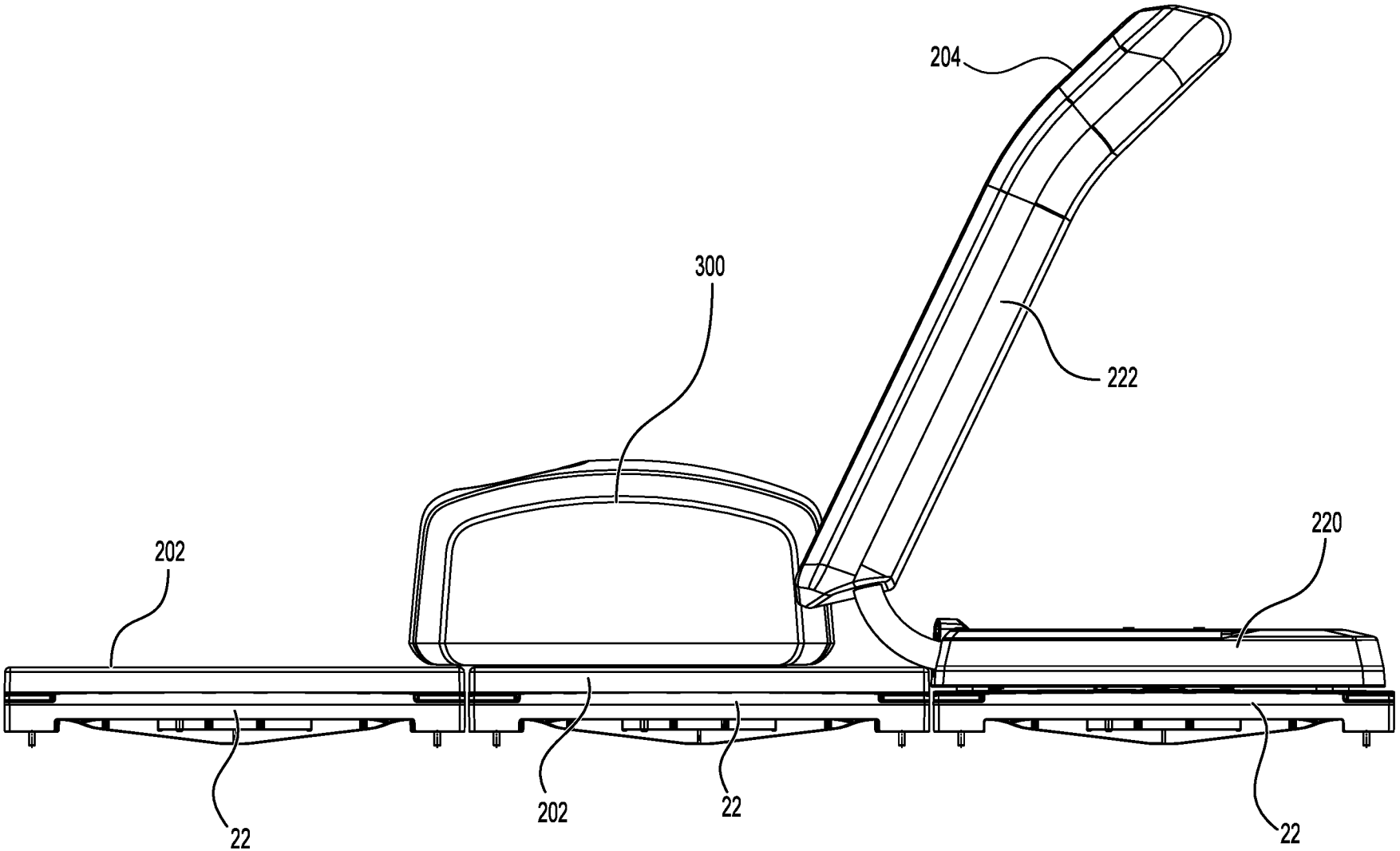
FIG. 22 is a left side elevation view of the part of the seating assembly and the floor tiles of FIG. 21.

The resilient members 214 are configured to be inserted into the recesses 115 of a corresponding floor tile 22 to connect the padded mat 202 thereto (see FIGS. 21, 22). More specifically, each grouped pair of the resilient members 214 is inserted into the recess 115 of a correspond cap 162 of one of the floor tiles 22 for engagement therewith. Notably, the interlocking portions 218 of the resilient members 214 deform as they are squeezed in upon being inserted into the recesses 215, and expand back into place once the outward-facing vertices 219 have traversed through the recesses 215. The engagement of the resilient members 214 with the recesses 115 thus secure the respective padded mat 202 to the deck 20. The resilient members 214 can be removed from the recesses 115 by pulling upward on the padded mat 202 with sufficient force.

In this embodiment, the body 205 of the padded mat 202 is made integrally as a single-piece component. In particular, the body 205 is made from a continuous material. In this embodiment, each body 205 is made of polyurethane and the resilient members 214 are made of a plastic material that is overmolded into the body 205. Other materials may be used in other embodiments. It is contemplated that, in other embodiments, the body 205 of the padded mat 202 could be constituted from different components that are assembled together to form the padded mat 202. For instance, in some embodiments, the padded mat 202 could include a base defining the lower face 208 and a pad, connected to the base, defining the upper face 206.

As shown in FIGS. 1, 6 and 7, in this embodiment, the padded mats 202 are grouped together to form a padded zone at which the occupants can rest by lying on the padded mats 202. Specifically, in this embodiment, the padded zone provided by the padded mats 202 are provided at a front portion of the deck 20. However, it is contemplated that, in other embodiments, the padded mats 202 could be provided elsewhere on the deck 20 (e.g., the rear portion of the deck 20). Moreover, in some embodiments, fewer padded mats 202 may be provided such that the padded zone is not as large. For instance, in some cases, even a single padded mat 202 may be provided by the seating assembly 100.

Figure 12:
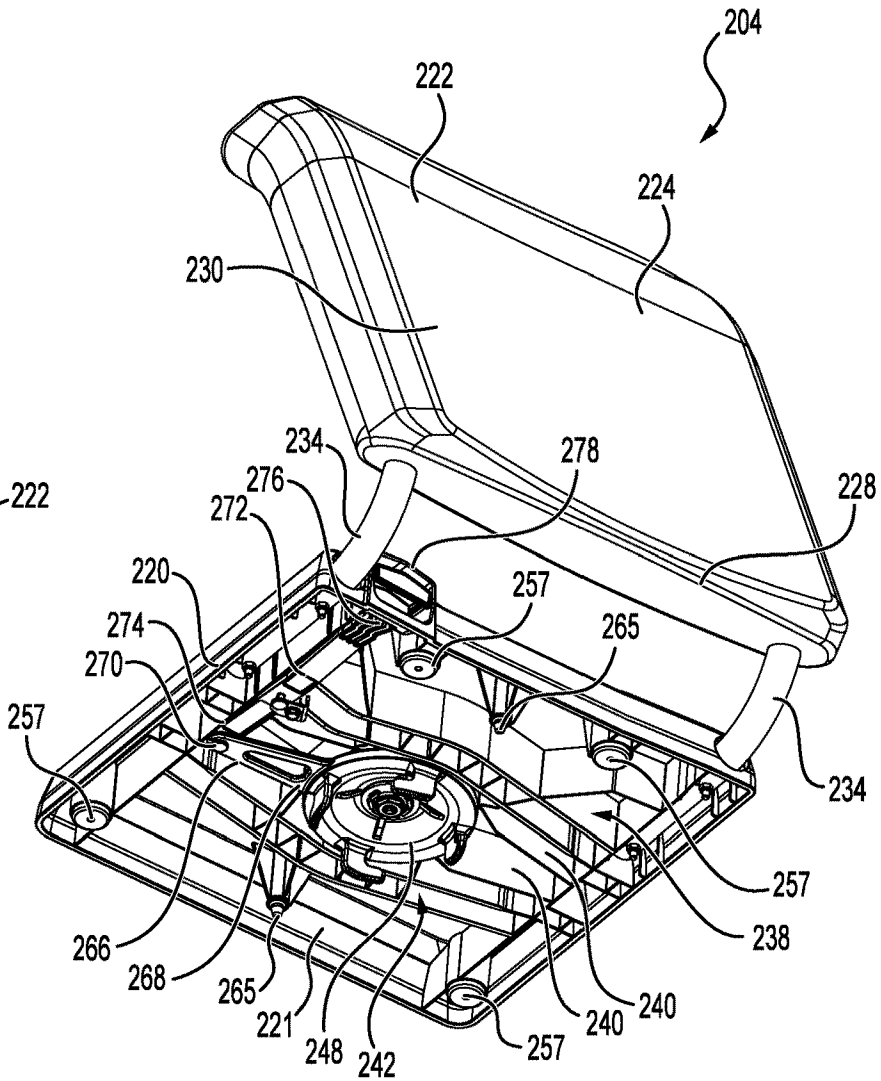
FIG. 12 is a perspective view, taken from a bottom, front, right side, of the backrest of FIG. 11.
Figure 11:
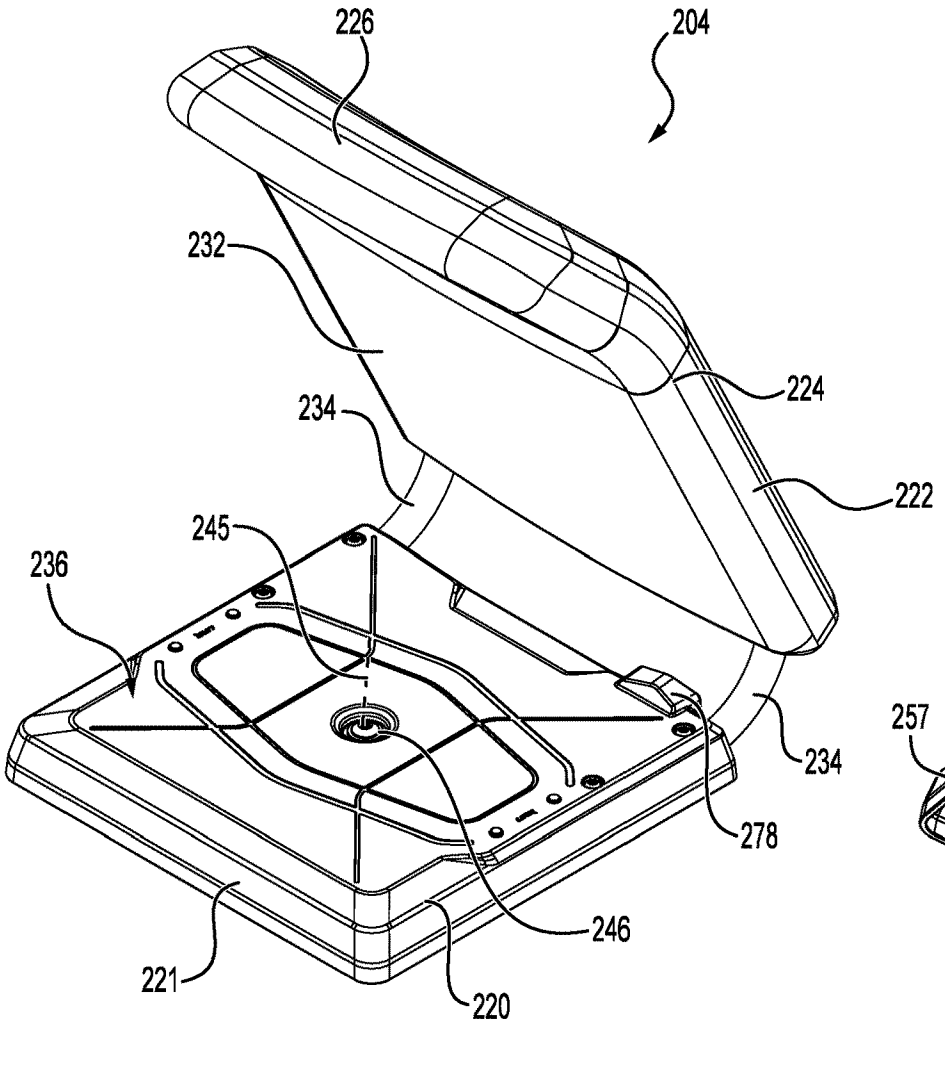
FIG. 11 is a perspective view, taken from a top, rear, right side, of a backrest of the seating assembly of FIG. 6.
Figure 13:
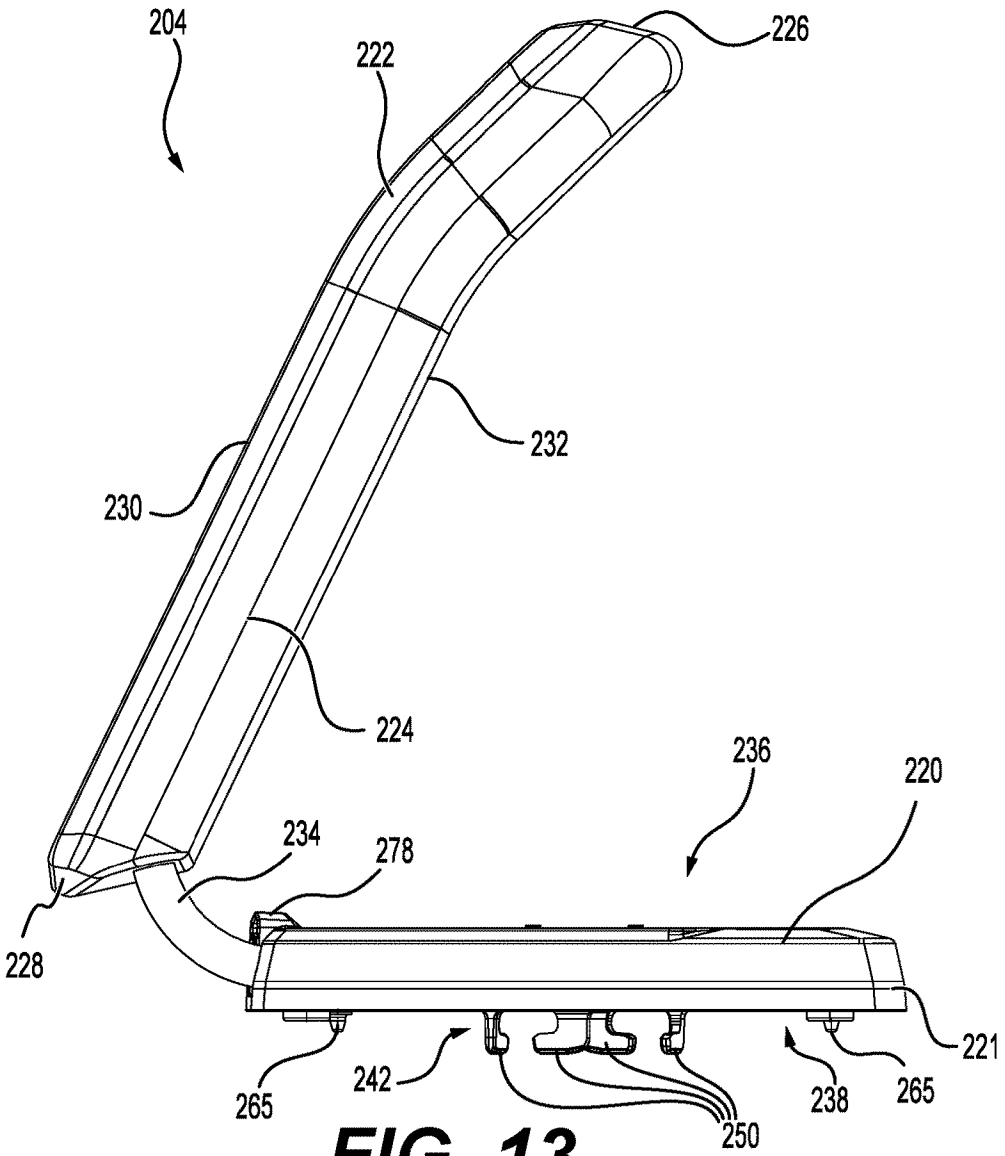
FIG. 13 is a left side elevation view of the backrest of FIG. 11.

Referring now to FIGS. 11 to 13, each backrest 204 has a base connecting portion 220 and a back support portion 222 connected to the base connecting portion 220. The base connection portion 220 is configured to selectively connect the backrest 204 to the deck 20 while the back support portion 222 is configured to support the user's back. In this embodiment, the back support portion 222 has a padded body 224 having an upper end 226 and a lower end 228. The padded body 224 also has support face 230 and a posterior face 232 opposite the support face 230. In use, the support face 230 supports the user's back. In this embodiment, two curved rods 234 extend within the padded body 224 and outward therefrom at the lower end 228 of the back support portion 222 and connect the back support portion 222 to the base connecting portion 220. As best shown in FIG. 13, the back support portion 222 extends vertically higher than the base connecting portion 220. Notably, the lower end 228 of the back support portion 222 is disposed vertically higher than an upper end of the base connecting portion 220 and extends upwardly and rearwardly from a front end of the base connecting portion 220.

It is contemplated that the back support portion 222 could be configured differently in other embodiments.

As shown in FIGS. 11 and 12, the base connecting portion 220 has an upper side 236 and a lower side 238 opposite the upper side 236. On the lower side 238, shown in FIG. 12, the base connecting portion 220 has a plurality of ribs 240 for reinforcing the base connecting portion 220. The base connecting portion 220 has a backrest attachment feature 242 for selectively connecting the backrest 204 to the deck 20 by engaging the backrest attachment feature 242 with a corresponding one the floor tiles 22 as will be described in more detail below. An attachment feature similar to the backrest attachment feature 242 is described in detail in U.S. patent application Ser. No. 16/887,481, filed May 29, 2020, and a full description thereof can be found therein. Therefore, a brief description of the backrest attachment feature 242 and a mechanism for operation thereof will be provided herein.

Figure 14:
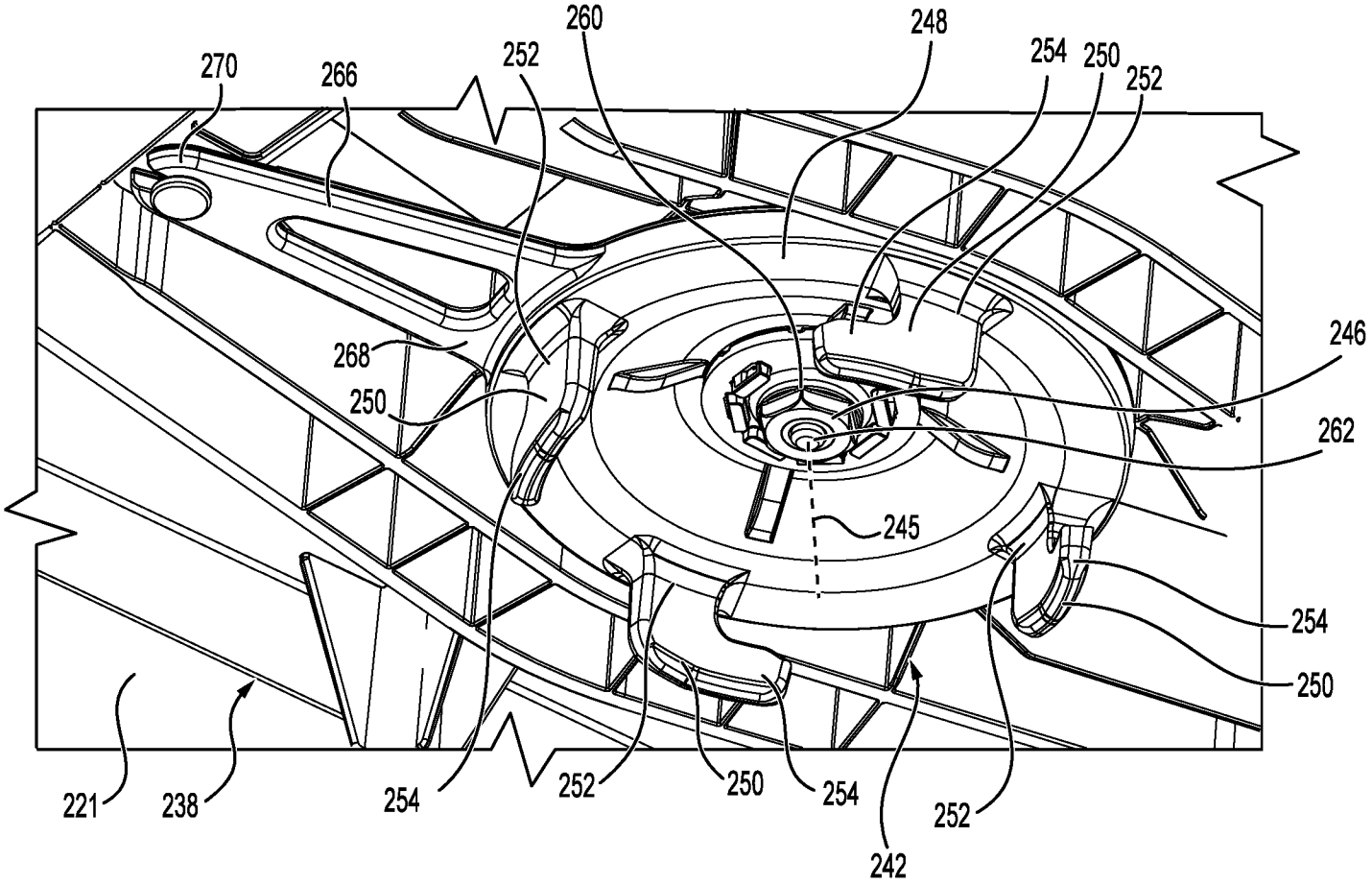
FIG. 14 is a perspective view, taken from a bottom, front, right side, of part of a base connecting portion of the backrest of FIG. 11.

In this embodiment, the backrest attachment feature 242 includes a pivotable attachment member 244 that is pivotably connected by a pivot 246 to a body 221 of the base connecting portion 220. As will be explained below, the pivotable attachment member 244 is operable by the user for rotation about a pivot axis 245 (FIG. 14). The pivotable attachment member 244 includes a disk 248 and four hooks 250 extending downward from the disk 248. A nut 260 is disposed underneath the disk 248 and a bolt 262 is inserted through a bore (not shown) defined by the body 221 of the base connecting portion 220 and through a bore (not shown) defined by the disk 248 so that the bolt 262 engages the nut 260, the disk 248 and the body 221 of the base connecting portion 220. In this manner, in this embodiment, the pivot 246 is established between the pivotable attachment member 244 and the body 221 of the base connecting portion 220.

With continued reference to FIG. 14, in this embodiment, the four hooks 250 are arcuate hooks 250. Each arcuate hook 250 includes a foot 252 fixedly connected to the disk 248 and a free end 254 extending perpendicularly from the foot 252. The feet 252 are narrower than the free ends 254 so that the free ends 254 extend beyond the feet 252 along a circumference of the disk 248. The four arcuate hooks 212 share a common center of curvature at the pivot axis 245 of the disk 248. The four arcuate hooks 212 also share a common radius of curvature. The four arcuate hooks 212 are evenly distributed on a circumference of the disk 248 so that the pivot axis 245 of the disk 248 and mid-points of two of the arcuate hooks 250 define a first axis on which these two arcuate slots are diametrically opposed. A second axis perpendicular to the first axis is defined by the pivot axis 245 of the disk 248 and mid-points of another two of the arcuate hooks 245.

As shown in FIG. 12, two locating pins 265 extend downwards from the body 221 of the base connecting portion 220 on the lower side 238. The locating pins 265 are located radially outward from the pivot axis 245, at equal distances therefrom. The pivot axis 245 and the two locating pins 265 are positioned on an axis parallel to a lateral side of the base connecting portion 220. As illustrated, one of the locating pins 265 is positioned toward the front of the base connecting portion 220 and another of the locating pins 265 is positioned toward the back of the the base connecting portion 220. It is contemplated that three or four locating pins 265 may be distributed on the the base connecting portion 220, each locating pin 265 being at equal distances form the pivot axis 245 and at equal distances from each other. It is also contemplated that only a single locating pin 265 could be provided. Instead of the locating pins 265, it is contemplated that differently shaped projections could extend under the bottom section 208 of the base 210. Moreover, as best shown in FIG. 12, four rubber supports 257 extending downwards from the body 221 on the lower side 238 are also provided.

Returning now to FIGS. 12 and 14, a link 266 extends radially outwards from the disk 248 and is located within the periphery of the base connecting portion 220. The link 266 has a medial end 268 connected to a periphery of the disk 248 and a lateral end 270 opposite from the medial end 268. An arm 272 has a proximal end 274 pivotably connected to the lateral end 270 of the link 266 and a distal end 276 protruding outside of the body 221 of the base connecting portion 220. A handle 278 is mounted to the distal end 276 of the arm 272. Sliding the arm 272 partially in or out of the body 221 of the base connecting portion 220 by action of the handle 278 causes pivoting of the link 266 and of the disk 248 about the pivot axis 245. In this embodiment, the disk 248 and the link 266 are configured to pivot over a range of 15 degrees. It is contemplated that in some other embodiments, the disk 248 and the link 266 could be configured to pivot up to a range of 15 degrees +/−5%.

Figure 15B:
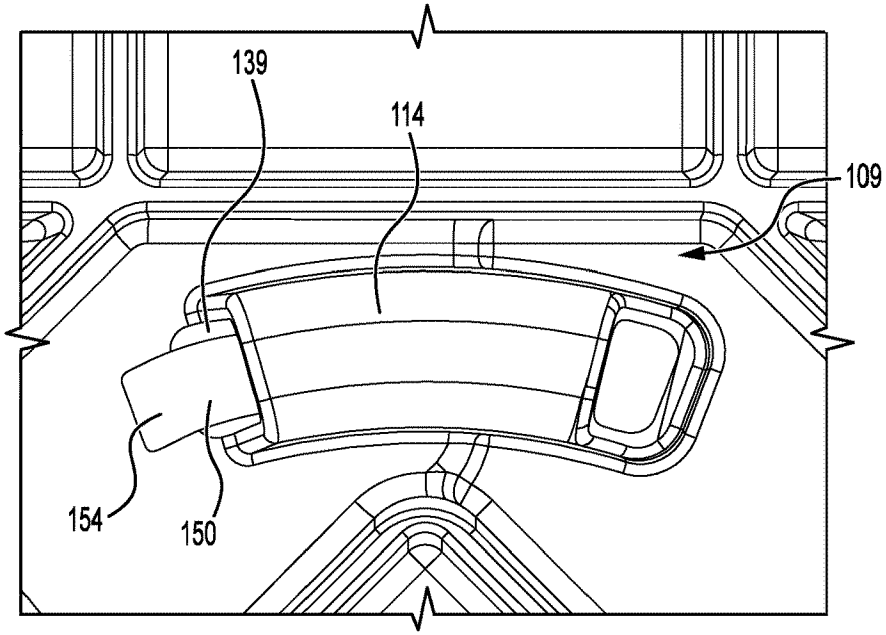
FIG. 15B is a bottom plan view of the part of the floor tile and the hook of the backrest interacting therewith in a locked position.
Figure 15A:
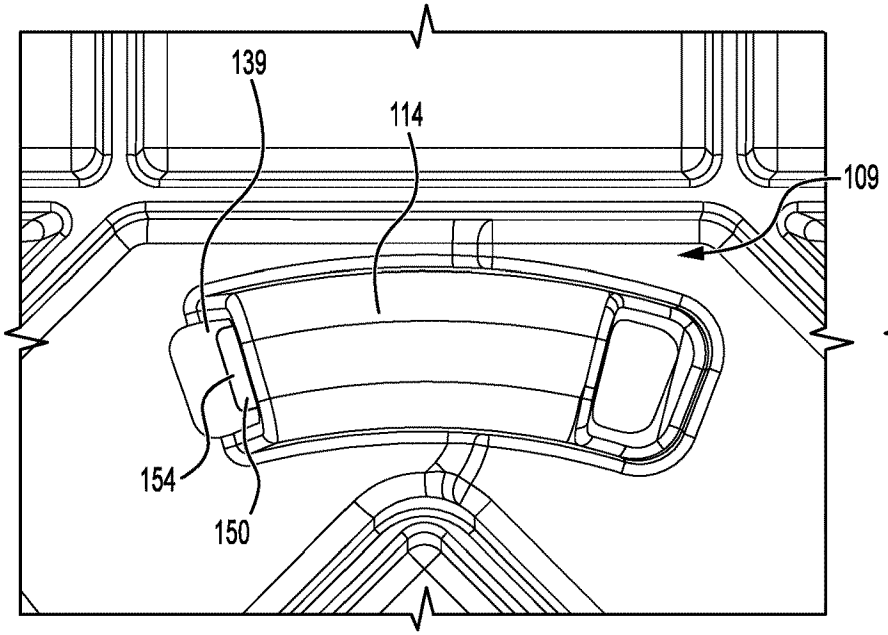
FIG. 15A is a bottom plan view of part of the floor tile and a hook of the backrest interacting therewith in an unlocked position.

In operation, to attach the backrest 204 to a corresponding floor tile 22 (see FIGS. 21, 22), the arm 272 and the handle 278 are initially pulled out from the body 221 of the base connecting portion 220 of the backrest 204. In this manner, the four arcuate hooks 250 are positioned for alignment with the four arcuate slots 102. The backrest 204 is properly positioned on the floor tile 22 by aligning the two locating pins 265 with corresponding ones of the four positioning cavities 108, and the four arcuate hooks 250 are inserted in the four arcuate slots 102. In this position of the backrest 204 on the floor tile 22, the common center of curvature 106 of the arcuate slots 102 is coaxial with the pivot axis 245. An overall height of the arcuate hooks 250 is selected so that the free ends 254 substantially reach the bottoms of the arcuate slots 102. Moreover, the arcuate hooks 250 are in an unlocked position, shown for one of the arcuate hooks 250 in FIG. 15A (which shows a view from the lower side 109 of the floor tile 22), in which the arcuate hooks 250 are freely removable from engagement with the arcuate slots 102. Notably, the free ends 254 can be simply lifted out of the arcuate slots 102 because the circumferential tip of each free end 254 does not extend out of the lateral opening 139 defined by the bottom wall 214.

When the backrest 204 is placed on the floor tile 22, the four rubber supports 257 abut against the upper surface 104 the floor tile 22. To lock the backrest 204 in position on the floor tile 22, the arm 278 is pushed inwards towards the body 221 of the base connecting portion 220 until the handle 278 is substantially flush with a front outer edge of the body 221.

This action of the arm 278 causes pivoting of the link 266 and the disk 248 by up to about 15 degrees in a first direction, which is counter-clockwise in this embodiment. As a result, the arcuate hooks 250 rotate within the arcuate slots 102. Pivoting the disk 248 causes the arcuate hooks 250 to pivot about the pivot axis 245 from the unlocked position (FIG. 15A) to a locked position (FIG. 15B) whereby the free ends 254 protrude from the arcuate slots 102 via the lateral openings 139. Thus, in the unlocked position, the arcuate hooks 250 are prevented from being removed from engagement with the arcuate slots 102. In this embodiment, the free ends 254 may protrude beyond the lateral openings 139 by up to 12.2 degrees. It is contemplated that in some other embodiments, the maximum protrusion of the free ends 216 could be in a range of 12 degrees +/−5%. The contact between the arcuate hooks 250 and the underside of the tile 22 at the lateral openings 139 of the arcuate slots 102 pulls the backrest 204 towards the floor tile 22 and presses the rubber supports 257 against the upper surface 104 of the floor tile 22. As such, downward vertical loads are passed from the backrest 204 to the floor tile 2 via the rubber supports 252. The about 15 degrees of rotation of the disk 248 provides sufficient contact between the arcuate hooks 250 and the underside of the tile 22 at the lateral openings 139 to take up significant pull-out loads that may be applied on the backrest 204.

To dismount the backrest 204 from the floor tile 22, the arm 278 is pulled outward from the body 221 to pivot the link 266 and the disk 248 by about 15 degrees in a second direction, which is clockwise in this embodiment, the second direction being opposite from the first direction. As such, the arcuate hooks 250 are pivoted about the pivot axis 245 from the locked position to the unlocked position. In this manner, the circumferential tips of the free ends 254 of the arcuate hooks 250 are substantially aligned with the arcuate slots 102, without protruding beyond the lateral openings 139. The backrest 204 may then be removed from the floor tile 22.

It may be noted that the backrest 204 could be similarly mounted on the floor tile 22 while having only two arcuate hooks 250 connected to the disk 248, these two arcuate hooks 250 being received in corresponding two of the arcuate slots 102. Also, in embodiments in which the floor tile 22 has four positioning cavities 108, the backrest 204 may be mounted thereon in any of four perpendicular directions, whether the backrest 204 includes one or more locating pins 265. It is also contemplated that the number and position of the positioning cavities 108 and locating pins 250 could be selected such that the backrest 204 could only be mounted in a particular direction.

Returning now to FIGS. 6 and 7, in this embodiment, the seating assembly 100 also includes two armrests 300 for supporting a respective arm of a user. Notably, the armrests 300 are usable together with the padded mats 202 and the backrests 204 to allow the user rest an arm on a respective armrest 300 while sitting on a given padded mat 202 and supported by one of the backrests 204. As will be explained in more detail below, each armrest 300 is configured to be mounted between two adjacent ones of the padded mats 202.

Figure 17:
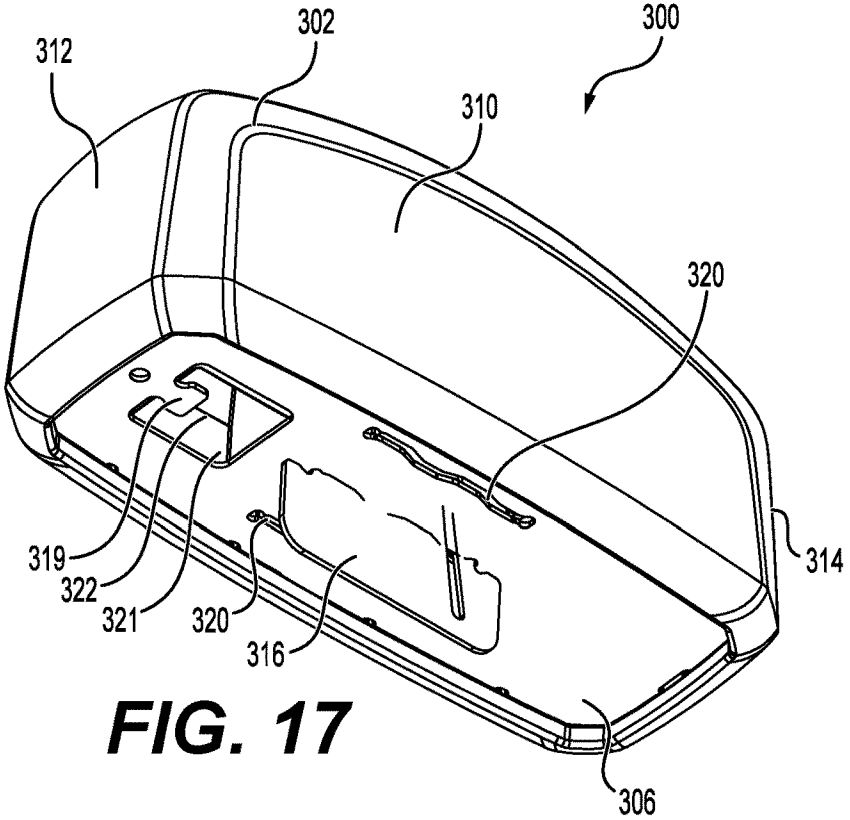
FIG. 17 is a perspective view, taken from a bottom, rear, right side, of the armrest of FIG. 16.
Figure 16:
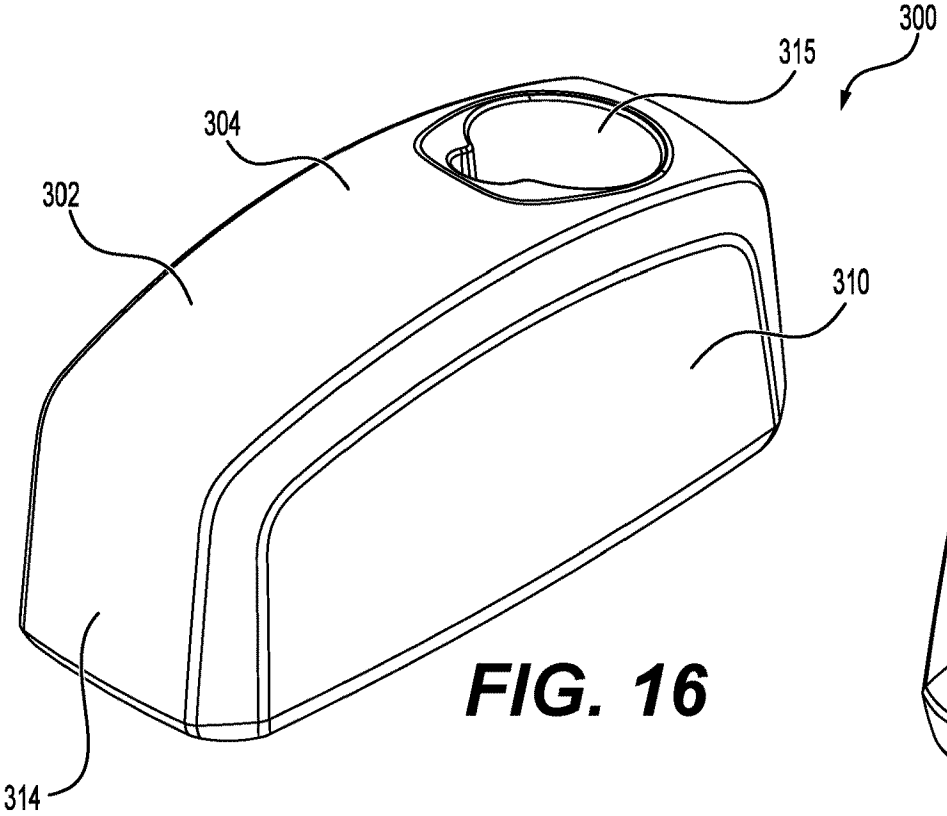
FIG. 16 is a perspective view, taken from a top, rear, right side, of an armrest of the seating assembly of FIG. 6.
Figures 18, 19:
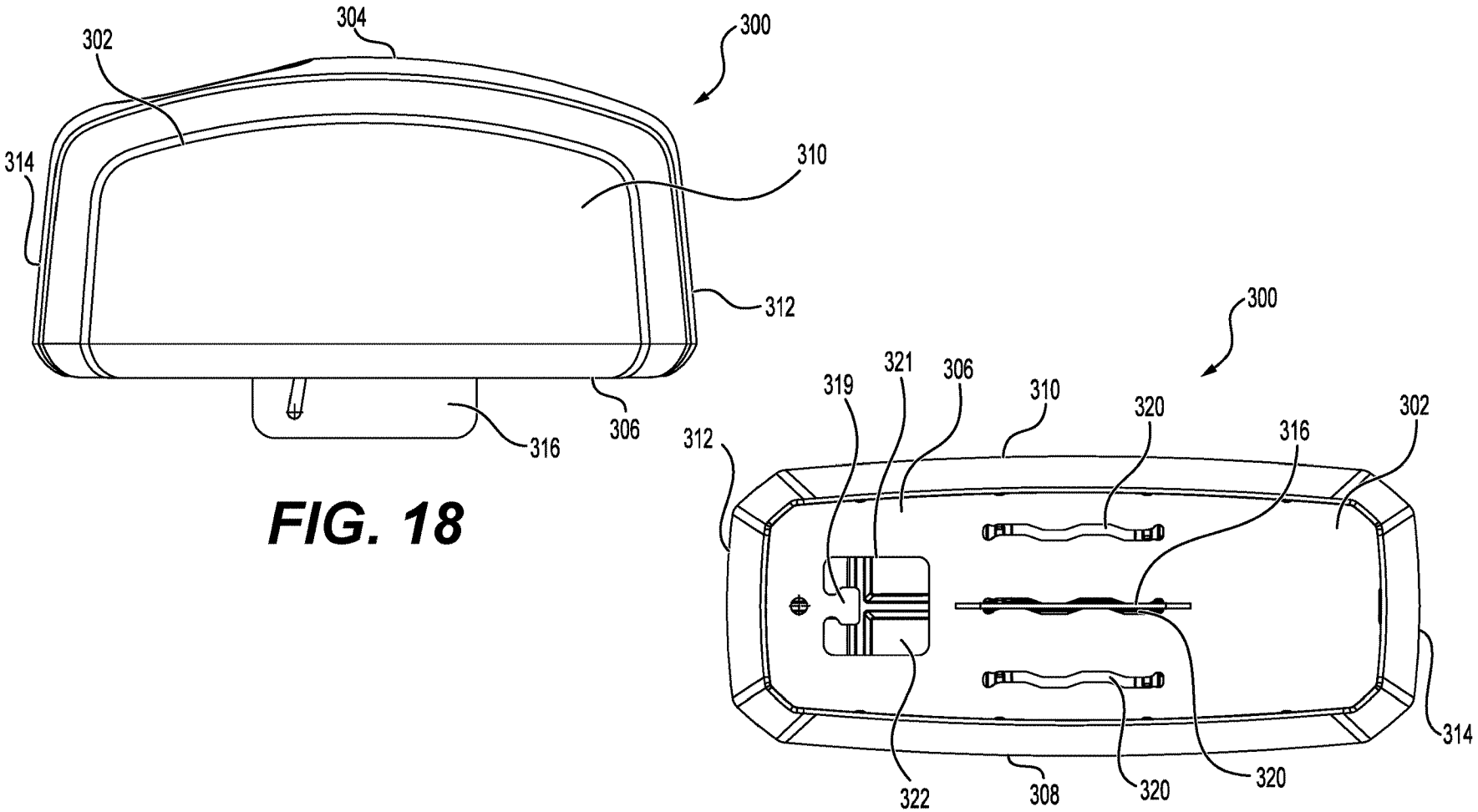
FIG. 18 is a left side elevation view of the armrest of FIG. 16.
FIG. 19 is a bottom plan view of the armrest of FIG. 16.

With reference to FIGS. 16 to 19, each armrest 300 has an armrest body 302 having an upper face 304 and a lower face 306 opposite the upper face 304. The armrest body 302 also has two opposite lateral ends 308, 310, and a front end 312 and a rear end 314. The upper face 304 defines a cupholder cavity 315. As shown in FIGS. 17 to 19, the armrest 300 has a flange 316 extending downwards from the lower face 306 for fixing the armrest 300 in place relative to two of the padded mats 202. More specifically, the flange 316 is insertable between two adjacent ones of the padded mats 202 to secure the armrest 300 in place. Notably, the flange 316 is squeezed between the two adjacent ones of the padded mats 202 such that the flange 316 is supported on both lateral sides thereof by a given one of the two padded mats 202. This allows the armrest 300 to stay upright and to be easily secured in place while also being easily removable by simply pulling the armrest 300 upwards.

Furthermore, in this embodiment, the flange 316 is selectively connectable to the armrest body 302 in one of a plurality of flange positions in order to allow adjustment of the position of the armrest 300 relative the two adjacent ones of the padded mats 202. In particular, the position of the armrest body 302 relative to the two adjacent ones of the padded mats 202 is adjustable by selectively connecting the flange 316 in a different one of the plurality of flange positions. To that end, in this embodiment, as best shown in FIG. 19, the armrest body 302 defines a plurality of flange recesses 320 on the lower face 306 for defining the flange positions. More specifically, part of the flange 316 is inserted within any one of the flange recesses 320 in order to connect the flange 316 in a given one of the flange positions. In this embodiment, the flange recesses 320 are spaced apart from one another laterally such that the flange recesses 320 are disposed at different distances from the lateral ends 308, 310 of the armrest body 302.

As shown in FIGS. 17 and 19, in this embodiment, the armrest body 302 also has a stowing interface feature 319 for facilitating stowing of the armrest body 302 on the boat 10 when the armrest 300 is not in use. In this embodiment, the stowing interface feature 319 is a tongue member provided on a lower side of the armrest 300 and defining in part the lower face 306. The tongue member 319 is provided near the front end 312 of the armrest body 302 and the tongue member 319 is flush with a remainder of the lower face 306. A stowing recess 322 is defined on the lower face 306 and is bounded by the tongue member 319 and an inner peripheral rim 321. When the armrest 300 is not in use, the armrest 300 can be stowed by engaging the tongue member 319 with a connecting base 330 (FIG. 20) of the boat 10. In particular, the armrest 300 is stowed by inserting the tongue member 319 into an interface aperture 325 of the connecting base 330, thus allowing the armrest 300 to hang from and be retained by the connecting base 330 with the armrest 300 being in a generally vertically orientation (i.e., the front and rear ends 312, 314 being spaced apart vertically).

Figure 20:
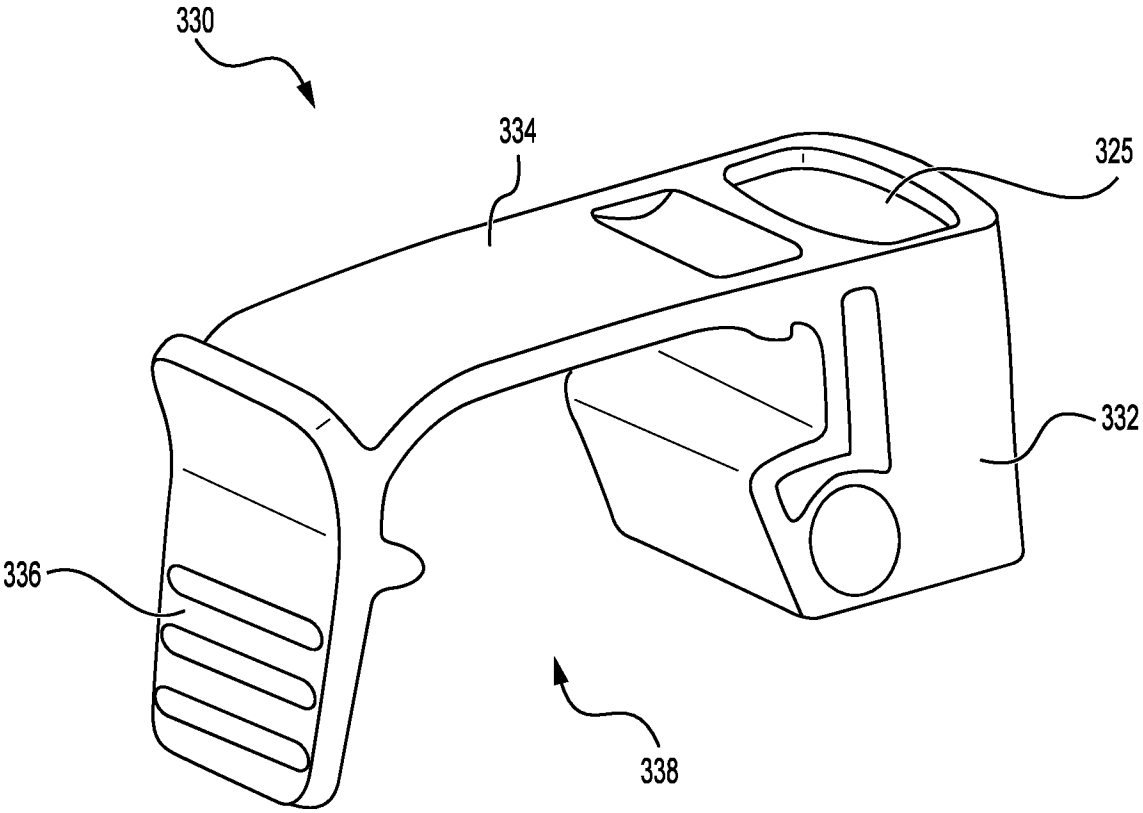
FIG. 20 is a perspective view, taken from top, front, left side, of a connecting base of the boat of FIG. 1.

With reference to FIG. 20, the connecting base 330 is configured for connection to the rail 60 (FIG. 1) of the barrier structure 50. The connecting base 330 has an interface portion 332 and an interconnector 334 extending therefrom. The interface portion 332 has an upper end defining the interface aperture 325 for receiving the tongue member 319 therein. The interconnector 334 has an end portion 336 opposite the interface portion 332. The interface portion 332 and the interconnector 334 together define a rail-receiving recess 338 in which a part of the rail 60 is received to secure the connecting base 330 thereto. Notably, part of the cross-sectional profile of the rail 60 matches a shape of the rail-receiving recess 338. A more complete description of a connecting base of the type described with respect to the connecting base 330 can be found in U.S. patent application Ser. No. 17/219,568, filed Mar. 31, 2021, the entirety of which is incorporated by reference herein.

Returning now to FIGS. 1, 6 and 7, in this embodiment, the seating assembly 100 also includes left and right rail pads 350 that are selectively connectable to the rails 60 of the left and right lateral barrier portions 56. In particular, in this embodiment, the rail pads 350 are selectively connectable to the front end sections 55 of the left and right lateral barrier portion 56. It is contemplated that, in other embodiments, the rail pads 350 could instead be connectable to the rails 60 of the other barrier portions or to different sections of the left and right lateral barrier portions 56. The rail pads 350 are usable together with the padded mats 202 such that a user can sit on one or more of the padded mats 202 while an upper body of the user (e.g., his/her head) is supported by one of the rail pads 350. In this embodiment, with reference to FIGS. 6 and 7, each rail pad 350 has a rail pad body 352 having a posterior face 354 and a support face 356 opposite the posterior face 354. The rail pad 350 has a rigid base 358 defining the posterior face 354 and a pad member 360 connected to the rigid base 35. The pad member 360 defines the support face 356 on which the user can rest his/her head or back. Fasteners 362 (FIG. 6) are used to fasten the rail pads 350 to the rails 60. The rail pads 350 could be configured differently in other embodiments.

As will be appreciated from the above, the seating assembly 100 provides an easy and convenient way for providing a place for a user to comfortably rest on the deck 20 without the usual restrictions of a more customary chair or bench. Moreover, while the components of the seating assembly 100 are illustrated herein in a particular position and orientation, the padded mats 202, the backrests 204, the armrests 300 and the rail pads 350 could be used in different positions and in different orientations in other embodiments. For instance, in some cases, the backrests 204 could be connected to the deck 20 such as to face laterally rather than forwardly.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A seating assembly for a watercraft, the watercraft comprising a deck including a plurality of deck attachment features provided on an upper surface of the deck, the seating assembly comprising:

at least one padded mat for seating a user, the at least one padded mat being configured to abut the upper surface of the deck, the at least one padded mat comprising a mat attachment feature for selectively connecting the at least one padded mat to the deck by engaging the mat attachment feature with one of the plurality of deck attachment features;

a backrest for supporting a back of the user, the backrest comprising a backrest attachment feature for selectively connecting the backrest to the deck by engaging the backrest attachment feature to an other one of the plurality of deck attachment features, the at least one padded mat and the backrest being usable together to allow the user to sit on the at least one padded mat and be supported by the backrest.

2. The seating assembly of claim 1, wherein:

the mat attachment feature and the backrest attachment feature are different;

the plurality of deck attachment features includes a first deck attachment feature and a second deck attachment feature;

the one of the plurality of deck attachment features is the first deck attachment feature; and the other one of the plurality of deck attachment features is the second deck attachment feature.

3. The seating assembly of claim 1, wherein:

the at least one padded mat has an upper face and a lower face, the lower face being configured to abut the upper surface of the deck;

the mat attachment feature includes a plurality of resilient fasteners extending downwards from the lower face; and the one of the plurality of deck attachment features comprises a plurality of first recesses for receiving the plurality of resilient fasteners.

4. The seating assembly of claim 3, wherein:

the at least one padded mat is generally rectangular; and the plurality of resilient fasteners are disposed near respective corners of the at least one padded mat.

5. The seating assembly of claim 1, wherein:

the backrest attachment feature comprises a pivotable attachment member that is operable by the user for rotation thereof about a pivot axis; and the other one of the plurality of deck attachment features comprises at least one opening for receiving part of the pivotable attachment member therein.

6. The seating assembly of claim 5, wherein:

the pivotable attachment member comprises a plurality of hooks;

the at least one opening is a plurality of openings;

the plurality of hooks of the pivotable attachment member are insertable into respective ones of the plurality of openings; and when the plurality of hooks are inserted into the plurality of openings, the plurality of hooks are pivotable about the pivot axis between an unlocked position whereby the plurality of hooks are freely removable from engagement with the plurality of openings and a locked position whereby the plurality of hooks are prevented from being removed from engagement with the plurality of openings.

7. The seating assembly of claim 1, wherein:

the backrest comprises a base connecting portion and a back support portion connected to the base connecting portion; and the base connecting portion comprises the backrest attachment feature.

8. The seating assembly of claim 7, wherein the back support portion extends vertically higher than the base connecting portion.

9. The seating assembly of claim 7, wherein the back support portion extends upwardly from a front end of the base connecting portion.

10. The seating assembly of claim 1, further comprising an armrest for supporting an arm of the user, the armrest being usable together with the at least one padded mat and the backrest to allow the user to rest an arm on the armrest while sitting on the at least one padded mat and supported by the backrest.

11. The seating assembly of claim 10, wherein:

the at least one padded mat is a plurality of padded mats; and the armrest is configured to be mounted between two adjacent ones of the plurality of padded mats.

12. The seating assembly of claim 11, wherein:

the armrest has an upper face and a lower face;

the armrest comprises a flange extending from the lower face of the armrest; and the flange is insertable between the two adjacent ones of the plurality of padded mats to secure the armrest in place.

13. The seating assembly of claim 12, wherein:

the armrest comprises an armrest body defining the upper face and the lower face thereof;

the flange is selectively connectable to the armrest body in one of plurality of flange positions; and a position of the armrest body relative to the two adjacent ones of the plurality of padded mats is adjustable by selectively connecting the flange in a different one of the plurality of flange positions.

14. The seating assembly of claim 13, wherein the armrest body defines a plurality of flange recesses for defining the plurality of flange positions, the flange being selectively connectable to the armrest body by inserting part of the flange within any one of the plurality of flange recesses.

15. The seating assembly of claim 14, wherein:

the armrest body has a first lateral end and a second lateral end; and the plurality of flange recesses are spaced apart from one another laterally such that the plurality of flange recesses are disposed at different distances from the first and second lateral ends.

16. The seating assembly of claim 13, wherein:

the armrest body comprises a stowing interface feature; and the armrest body is configured to be stowed by engaging the stowing interface feature with a corresponding connecting base of the watercraft such as to retain the armrest body on the connecting base.

17. The seating assembly of claim 1, wherein:

the watercraft comprises a rail at least partly surrounding the deck; and the seating assembly further comprises at least one rail pad configured to be connected to the rail, the at least one rail pad and the at least one padded mat being usable together to allow the user to sit on the at least one padded mat and be supported by the at least one rail pad.

18. The seating assembly of claim 1, wherein:

the at least one padded mat has an upper face and a lower face;

a thickness of the at least one padded mat is measured from the upper face to the lower face; and the upper face of the at least one padded mat is distanced from the upper surface of the deck by a distance equal to the thickness of the at least one padded mat.

19. A seating system for a watercraft, comprising:

a deck comprising a plurality of deck attachment features on an upper surface of the deck; and the seating assembly of claim 1, the mat attachment feature of each of the at least one padded mat being engageable with one of the plurality of deck attachment features for selectively connecting the at least one padded mat to the deck, and the backrest attachment feature of the backrest being engageable with an other one of the plurality of deck attachment features for selectively connecting the backrest to the deck.

20. The seating system of claim 19, wherein the deck comprises a plurality of floor tiles defining the upper surface of the deck, each of the plurality of floor tiles comprising at least one of the plurality of deck attachment features.

21. The seating system of claim 19, wherein the at least one padded mat is a plurality of padded mats that are connectable to the deck at a front portion of the deck.

22. A watercraft comprising:

a deck comprising a plurality of deck attachment features on an upper surface of the deck;

a hull supporting the deck;

at least one padded mat for seating a user, the at least one padded mat abutting the upper surface of the deck, the at least one padded mat comprising a mat attachment feature engaging one of the plurality of deck attachment features for selective connection of the at least one padded mat to the deck;

a backrest for supporting a back of the user, the backrest comprising a backrest attachment feature engaging an other one of the plurality of deck attachment features for selective connection of the backrest to the deck, the backrest being disposed next to the at least one padded mat such that the user can sit on the at least one of the at least one padded mat and be supported by the backrest.

23. The watercraft of claim 22, wherein:

the backrest comprises a base connecting portion and a back support portion connected to the base connecting portion;

the base connecting portion comprises the backrest attachment feature; and the back support portion extends upwardly and rearwardly from the base connecting portion.

24. The watercraft of claim 22, wherein:

the watercraft further comprises a rail at least partly surrounding the deck;

the watercraft further comprises at least one rail pad connected to the rail; and the at least one rail pad and the at least one padded mat being usable together to allow the user to sit on the at least one padded mat and be supported by the at least one rail pad.

* * * * *